US011293242B2

(12) United States Patent
Skaugen et al.

(10) Patent No.: US 11,293,242 B2
(45) Date of Patent: Apr. 5, 2022

(54) SYSTEMS AND METHODS FOR MANAGING FLUID PRESSURE IN A BOREHOLE DURING DRILLING OPERATIONS

(71) Applicant: National Oilwell Varco Norway AS, Stavanger (NO)

(72) Inventors: Geir K. Skaugen, Stavanger (NO); Karl Erik Thoresen, Hafrsfjord (NO); Åge Kyllingstad, Ålgård (NO)

(73) Assignee: NATIONAL OILWELL VARCO NORWAY AS, Stavanger (NO)

( * ) Notice: Subject to any disclaimer, the term of this patent is extended or adjusted under 35 U.S.C. 154(b) by 456 days.

(21) Appl. No.: 16/311,308

(22) PCT Filed: Jul. 6, 2017

(86) PCT No.: PCT/US2017/040993
§ 371 (c)(1),
(2) Date: Dec. 19, 2018

(87) PCT Pub. No.: WO2018/009728
PCT Pub. Date: Jan. 11, 2018

(65) Prior Publication Data

US 2019/0242204 A1 Aug. 8, 2019

Related U.S. Application Data

(60) Provisional application No. 62/359,590, filed on Jul. 7, 2016.

(51) Int. Cl.

| | |
|---|---|
| ***E21B 21/08*** | (2006.01) |
| ***E21B 21/10*** | (2006.01) |
| *E21B 41/00* | (2006.01) |

(52) U.S. Cl.
CPC ..... *E21B 21/08* (2013.01); *E21B 21/106* (2013.01); *E21B 41/0092* (2013.01)

(58) Field of Classification Search
CPC ..... E21B 21/08; E21B 21/10; E21B 21/106; E21B 41/0092
See application file for complete search history.

(56) References Cited

U.S. PATENT DOCUMENTS 4,483,399 A * 11/1984 Colgate ..... E21B 7/20 166/207
5,890,549 A * 4/1999 Sprehe ..... E21B 21/07 175/71

(Continued)

OTHER PUBLICATIONS

PCT/US2017/040993 International Search Report and Written Opinion dated Sep. 11, 2017 (13 p.).

*Primary Examiner* — Christopher J Sebesta
(74) *Attorney, Agent, or Firm* — Conley Rose, P.C.

(57) ABSTRACT

A method for drilling a borehole includes selecting a lower pressure limit and an upper pressure limit for a drilling fluid at a drilling location in the borehole. In addition, the method includes activating a pump to circulate the drilling fluid down a drill string and up an annulus disposed about the drill string. Further, the method includes operating the pump to maintain the drilling fluid at the drilling location at a pressure between the upper and the lower pressure limits. Still further, the method includes deactivating the pump to stop circulating the drilling fluid up the annulus. The method also includes sealing the drilling fluid in the annulus at a selected time after deactivating the pump and maintaining the pressure of the drilling fluid at the drilling location between the lower and the upper pressure limits.

20 Claims, 11 Drawing Sheets

(56) References Cited

U.S. PATENT DOCUMENTS

| | | | | |
|---|---|---|---|---|
| 6,904,981 | B2 | 6/2005 | Van Riet | |
| 7,395,878 | B2 | 7/2008 | Reitsma et al. | |
| 8,347,983 | B2 * | 1/2013 | Hoyer | E21B 33/13 175/22 |
| 9,080,407 | B2 * | 7/2015 | Bernard | E21B 44/00 |
| 2001/0042642 | A1 | 11/2001 | King | |
| 2007/0246263 | A1 * | 10/2007 | Reitsma | E21B 21/08 175/38 |
| 2011/0174541 | A1 | 7/2011 | Strachan et al. | |
| 2012/0146807 | A1 * | 6/2012 | Hutin | E21B 47/20 340/854.5 |
| 2015/0345239 | A1 | 12/2015 | Samuel et al. | |
| 2016/0097270 | A1 | 4/2016 | Pobedinski et al. | |

* cited by examiner

SYSTEMS AND METHODS FOR MANAGING FLUID PRESSURE IN A BOREHOLE DURING DRILLING OPERATIONS

CROSS-REFERENCE TO RELATED APPLICATIONS

This application is a 35 U.S.C. § 371 national stage application of PCT/US2017/040993 filed Jul. 6, 2017, and entitled "Systems and Methods for Managing Fluid Pressure in a Borehole During Drilling Operations," which claims benefit of U.S. provisional patent application Ser. No. 62/359,590 filed Jul. 7, 2016, and entitled "Systems and Methods for Managing Fluid Pressure in a Borehole During Drilling Operations", each of which is hereby incorporated herein by reference in its entirety for all purposes.

STATEMENT REGARDING FEDERALLY SPONSORED RESEARCH OR DEVELOPMENT

Not applicable.

BACKGROUND

The present disclosure relates generally to systems and methods for managing and controlling the pressure of drilling fluids in boreholes during drilling operations. More particularly, the disclosure relates to systems and methods for managing the pressure of drilling fluid in a borehole by controlling the discharge of drilling fluid from the borehole as is performed, for example, during managed pressure drilling (MPD).

To drill a borehole in an earthen formation to a subterranean reservoir, a drilling rig is positioned over the desired location of the borehole and a drill string suspended from the drilling rig through a blowout preventer (BOP) mounted to a wellhead at the surface and into the subterranean formation. During the drilling process, drilling fluid or mud is pumped through the drill string and exits the face of a drill bit connected to the lower end of the drill string. The drilling fluid exiting the drill bit is recirculated to the surface via the annulus between the drill string and the inner surface of the wellbore and then through the annulus between the drilling and the inner surface of the BOP. The drilling fluid in the annulus directly contacts the formation, thereby exerting pressure against the formation.

During drilling operations, it is generally desirable to maintain the drilling fluid pressure in the annulus sufficiently high to inhibit or reduce the influx of formation fluids into the borehole, while avoiding excessively high pressure that may inadvertently fracture the formation and lead to significant drilling fluid loss into the formation. Managed Pressure Drilling (MPD) describes drilling operations in which the annular pressure profile in the borehole is controlled. Typically, fluid pressure in the borehole is managed during MPD by the adjusting the density, and hence weight, of the drilling fluid to control the hydrostatic pressure in the borehole and by adjusting the pressure supplied by the mud pump. However, when the mud pumps are temporarily stopped during drilling, such as to make or break pipe joint connections along the drill string, the flow of mud ceases. At such times, the mud pumps may not capable of adjusting the drilling fluid pressure within the annulus, and further, the mud weight cannot be dynamically adjusted.

BRIEF SUMMARY OF THE DISCLOSURE

Embodiments of methods for drilling boreholes in earthen formations are disclosed herein. In one embodiment, a method for drilling a borehole in an earthen formation using a drilling fluid comprises (a) selecting a lower pressure limit for the drilling fluid at a drilling location in the borehole. In addition, the method comprises (b) selecting an upper pressure limit for the drilling fluid at the drilling location in the borehole. Further, the method comprises (c) activating a pump to circulate the drilling fluid down a drill string to a drill bit at a lower end of the drill string, out the drill bit into the borehole, and up an annulus disposed about the drill string. A check valve is disposed in the drill string proximal the lower end, and a control valve is positioned along the annulus. The check valve is configured to allow one-way flow of the drilling fluid down the drill string and out the face of the bit. While being circulated, the drilling fluid passes through the drilling location. Still further, the method comprises (d) rotating the drill bit to drill the borehole. Moreover, the method comprises (e) operating the pump to maintain the drilling fluid at the drilling location at a pressure that is between the upper pressure limit and the lower pressure limit. The method also comprises (f) deactivating the pump to stop circulating the drilling fluid. In addition, the method comprises (g) preventing the drilling fluid from flowing up the drill string with the check valve after (f). Further, the method comprises (h) closing the control valve at a selected time after deactivating the pump in (f) to seal the drilling fluid in the annulus between the check valve and the control valve and maintain the pressure of the drilling fluid at the drilling location greater than the lower pressure limit and less than the upper pressure limit after (g).

Embodiments of systems for controlling borehole pressure during drilling operations are disclosed herein. In one embodiment, a system for controlling borehole pressure during drilling operations comprises a drill string extending through a borehole. The drill string has an upper end, a lower end, a drill bit disposed at the lower end, and a check valve at a lower end. The check valve is configured to allow one-way flow of a drilling fluid down the drill string and out the drill bit. An annulus is disposed between the drill string and a sidewall of the borehole. In addition, the system comprises a control valve configured to selectively open and close the annulus. The control valve is positioned at an upper end of the borehole. Further, the system comprises a drilling fluid circulation system including a first pump coupled to the upper end of the drill string and configured to pump the drilling fluid down the drill string. The drilling fluid circulation system also includes a return line in fluid communication with the annulus above the control valve. Still further, the drilling fluid circulation system includes a fluid pressure control system configured to operate the control valve and the first pump. The fluid pressure control system includes a processor and a non-transitory computer-readable storage medium. The storage medium stores instructions that when executed by the processor cause the processor to: (i) select a lower pressure limit for the drilling fluid at a drilling location in the borehole; (ii) select an upper pressure limit for the drilling fluid at the drilling location in the borehole; (iii) activate the first pump to circulate the drilling fluid down the drill string and out the drill bit into the borehole; (iv) operate the first pump to maintain the drilling fluid at the drilling location at a pressure that is between the upper pressure limit and the lower pressure limit; (vi) deactivate the first pump to stop circulating the drilling fluid down the drill string and out the drill bit; and (vii) close the control valve at a selected time after deactivating the first pump in (vi) to seal the drilling fluid in the annulus between the check valve and the control valve and maintain the pressure of the drilling fluid at the drilling location greater than the lower pressure limit and less than the upper pressure limit.

Embodiments of methods for drilling boreholes in earthen formations are disclosed herein. In one embodiment, the method comprises (a) drilling a borehole in an earthen formation with a drill bit disposed at a lower end of a drill string extending through the borehole. In addition, the method comprises (b) pumping a drilling fluid down a drill string and up an annulus between the drill string and a sidewall of the borehole. Further, the method comprises (c) ceasing the pumping of the drilling fluid down the drill string and up the annulus. Still further, the method comprises (d) preventing the drilling fluid from flowing up the drill string after (c). Moreover, the method comprises (e) sealing the annulus proximal an upper end of the borehole after a first predetermined period of time after (c). The method also comprises (f) using a pressure simulation model to determine the first predetermined period of time.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the disclosed exemplary embodiments, reference will now be made to the accompanying drawings, which include the following figures.

NOTATION AND NOMENCLATURE

Figure 1:
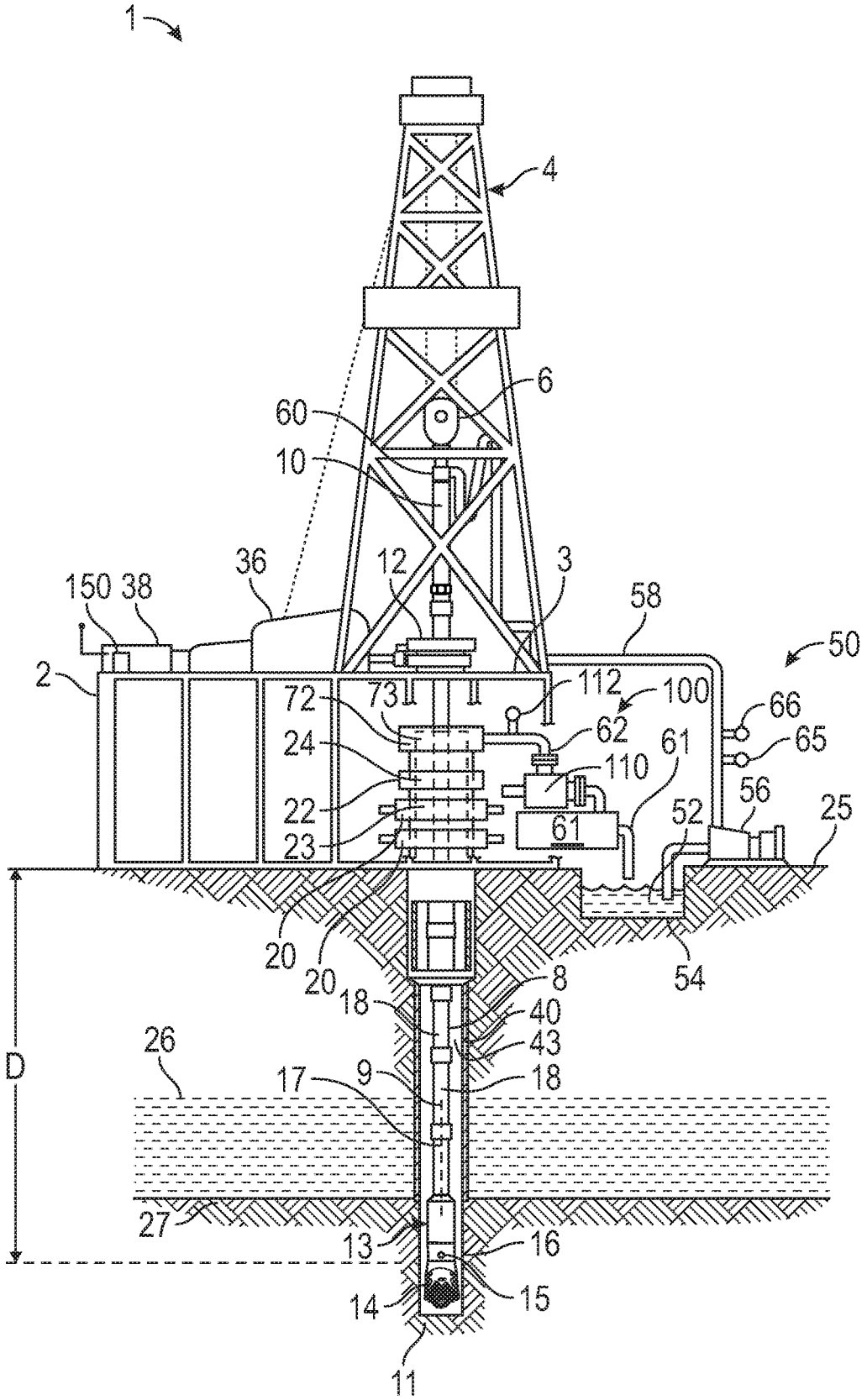
FIG. 1 is a schematic elevation view of an embodiment of a system for drilling a borehole while controlling borehole pressure in accordance with principles disclosed herein.

The following description is exemplary of certain embodiments of the disclosure. One of ordinary skill in the art will understand that the following description has broad application, and the discussion of any embodiment is meant to be exemplary of that embodiment, and is not intended to suggest in any way that the scope of the disclosure, including the claims, is limited to that embodiment.

The drawing figures are not necessarily to scale. Certain features and components disclosed herein may be shown exaggerated in scale or in somewhat schematic form, and some details of conventional elements may not be shown in the interest of clarity and conciseness. In some of the figures, in order to improve clarity and conciseness, one or more components or aspects of a component may be omitted or may not have reference numerals identifying the features or components. In addition, within the specification, including the drawings, like or identical reference numerals may be used to identify common or similar elements.

Certain terms are used throughout the following description and the claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." The word "or" is used in an inclusive manner. For example, "A or B" means any of the following: "A" alone, "B" alone, or both "A" and "B." In addition, as may be herein including the claims, the word "substantially" means within a range of plus or minus 10%. The recitation "based on" means "based at least in part on." Therefore, if X is based on Y, then X may be based on Y and any number of other factors. Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims will be made for purposes of clarity, with "up", "upper", "upwardly" or "upstream" meaning toward the surface of the borehole and with "down", "lower", "downwardly" or "downstream" meaning toward the terminal end of the borehole, regardless of the borehole orientation.

DETAILED DESCRIPTION OF THE DISCLOSED EMBODIMENTS

Disclosed herein are embodiments of systems and methods for controlling the flow rate and pressure of fluid within a wellbore. The systems and methods described herein are particularly suited for managed pressure drilling (MPD); however, it is anticipated that other uses in well operations will be develop for the systems and methods disclosed herein as they are implemented and appreciated in the oil field industry. During MPD, the pressure of a drilling fluid in the borehole is kept within a targeted range of pressure between a lower pressure limit that is preferably greater than or equal to the pore pressure in an adjacent earthen formation and an upper pressure limit less than or equal to the formation fracture pressure in an adjacent earthen formation. The weight of the drilling fluid in the borehole exerts a hydrostatic pressure, when the fluid is pumped into and out from the borehole, it additionally exerts a dynamic pressure. Sometimes the difference between the lower and the upper pressure limits (i.e. span or "window" of the targeted pressure range) is less than the dynamic pressure that develops in the fluid during pumping. In some such situations, in order to stay below the fracturing pressure of the formation while pumping (the period when the drill fluid pressure is the highest), the drilling fluid must be formulated so its hydrostatic pressure is less than the lower limit. However, for such a formulation of drilling fluid, when pumping stops, there is an undesirable potential for formation fluids to enter the borehole. To overcome this potential problem, the systems and methods described herein are configured to maintain the pressure of downhole drilling fluid within the targeted range of pressure during periods when drilling fluid remains in the wellbore but is not being pumped or is not circulating through the well bore.

Referring now to FIG. 1, an embodiment of a drilling system 1 in accordance with the principles described herein is shown. Drilling system 1 includes a derrick 4 supported by a drilling platform 2. Platform 2 has a drill deck or floor 3 supporting a rotary table 12 selectively rotated by a prime mover (not shown) such as an electric motor controlled by a motor controller. The derrick 4 includes a traveling block 6 controlled by a drawworks 36 for raising and lowering a drill string 8 suspended from the block 6.

The drill string 8 extends downward through the rotary table 12, a blowout preventer stack (BOP) 20, and an annulus pressure control valve 22 into borehole 16. Drill string 8 has a central or longitudinal axis 9 and is formed by a plurality of pipe joints 18 connected end-to-end. A bottom-hole-assembly (BHA) 13 is attached to the lowermost joint 18 and a drill bit 14 is attached to the lower end of BHA 13. BHA 13 includes, as examples, a drill collar, a mud motor, a pressure sensor 15, or other sensors or tools. Sensor 15 measures the fluid pressure within annulus 43 between the drill string 8 and the surrounding formation proximal bit 14.

In this embodiment, drill bit 14 is rotated with rotary table 12 via drill string 8 and BHA 13. By rotating drill bit 14 with weight-on-bit (WOB) applied, the drill bit 14 disintegrates the subsurface formations to drill a borehole 16, which may also be referred to as a well bore. Borehole 16 has a centerline or longitudinal axis 17 generally aligned with axis 9 and may pass through multiple subsurface formations or zones 26, 27. The weight-on-bit, which impacts the rate of penetration of the bit 14 through the formations 26, 27, is controlled by traveling block 6 and a drawworks 36, which includes a motor and a motor controller. In some embodiments of the drilling system 1, a top-drive may be used to rotate the drill string 8 rather than rotation by the rotary table 12 and the kelly 10. In some applications, a downhole motor (mud motor) is disposed in the drilling string 8 to rotate the drill bit 14 in lieu of or in addition to rotating the drill string 8 from the earth's surface 25. The mud motor rotates the drill bit 14 when a drilling fluid passes through the mud motor under pressure. As drilling progresses, the borehole 16 penetrates a subsurface formation, zone, or reservoir, such as reservoir 11 in subsurface formation 27 that is believed to contain hydrocarbons in a commercially viable quantity.

Referring still to FIG. 1, drilling operations with system 1 are performed with the aid of a drilling control system 38. In general, drilling control system 38 may be mounted on platform 2 or at a distance from platform 2, or portions of system 38 may be distributed at various locations. The various operations by drilling control system 38 may be performed autonomously or may be manually controlled by an operator. As will be described in more detail below, a fluid pressure control system 150 logically coupled to or contained within control system 38 operates the control valve 22 and is configured to maintain the pressure of drilling fluid in the annulus 43 within a targeted range during drilling operations and during periods of time when drilling fluid 52 remains in the wellbore but is not flowing or is not being pumped.

A casing 40 is installed and extends downward generally from the earth's surface 25 into at least a portion of borehole 16 along axis 17. Typically, casing 40 is cemented within the borehole 16 to isolate various vertically-separated earthen zones, such as zones 26, 27, preventing fluid transfer between the zones. BOP 20 is secured to the upper end of casing 40 and control valve 22 is coupled to or integrated with BOP 20. Casing 40 comprises multiple tubular members, such as pieces of threaded pipe, joined end-to end to form liquid-tight or gas-tight connections, to prevent fluid and pressure exchange between the inner surface of casing 40 and a surrounding earthen zone.

Referring still to FIG. 1, the annular space or annulus 43 is formed between the sidewall of borehole 16 and drill string 8 and between casing 40 and drill string 8. In other words, annulus 43 extends through borehole 16 and casing 40. BOP 20 and control valve 22 include an annular space or flow path 23 in fluid communication with annulus 43. BOP 20 and valve 22 are each configured to selectively seal the annular flow path 23 from annulus 43, and hence selectively seal annulus 43, at the surface 25. In particular, control valve 22 is configured as an annular seal member and functions to engage and seal around tubular string 8, thereby closing off the annular flow path 23 and annulus 43 to inhibit fluid contained therein from discharging upward. The lower end of valve 22 is coupled to BOP 20, and its upper end is coupled to a fluid discharge coupling 72 such as a rotating control device (RCD). Valve 22 includes a throughbore 24 that defines a portion of the annular flow path 23. In this embodiment, control valve 22 is an annular blowout preventer comprising an annular elastomeric sealing element configured to squeeze radially inward to seal on a tubular extending through bore 24 (e.g., a string 8, casing, drill pipe, drill collar, etc.) or seal off bore 24. An operator, the drilling control system 38, or the fluid pressure control system 150 may selectively and controllably open and close the valve 22 to allow, to restrict, or to inhibit the flow of drilling fluid or another fluid through flow path 23 and annulus 43. Although control valve 22 is an annular blowout preventer in this embodiment, in other embodiments, the control valve (e.g., control valve 22) may comprise another type of valve such as pipe rams, shear rams, ball valve, or the like.

Referring still to FIG. 1, a drilling fluid circulation system 50 is provided to circulate drilling fluid or mud 52 down drill string 8 and back up annulus 43. Drilling fluid 52 generally functions to cool drill bit 14, remove cuttings from the bottom of borehole 16, and maintain a desired pressure or pressure profile in borehole 16 during drilling operations. In this embodiment, circulation system 50 includes a drilling fluid reservoir or mud tank 54, a supply pump 56, a supply line 58 connected to the outlet of pump 56, a supply coupling 60, the kelly 10, the drill string 8, and the annulus 43, the annular flow path 23, the drilling fluid discharge coupling 72, a drilling fluid return line 62, and a drilling fluid regulating device 110 coupled to discharge coupling 72 and the return line 62. A drilling fluid flow path extends through the components of circulation system 50. Fluid circulation system 50 also includes a pressure sensor 112 installed proximal and in fluid communication with the discharge coupling 72 as well as a pressure sensor 65 and a flow sensor 66 located in line 58 beyond the discharge of the mud pump 56.

Regulating device 110 is configured to control the flow rate or pressure of drilling fluid 52 while it is being pumped through the drilling fluid flow path, as is appropriate for the process of managed pressure drilling. Supply coupling 60 couples the non-rotating supply line 58 to the upper end of the rotatable drill string 8. Coupling 60 may a wash pipe assembly, for example. Discharge coupling 72 surrounds drill string 8 and is coupled to the upper end of BOP 20. Drill string 8 extends through discharge coupling 72 so that an annular space or annulus 73 is located between the outer surface of drill string 8 and the inner surface of discharge coupling 72. Annulus 73 forms a portion of the mud flow path. Via annulus 73, coupling 72 provides fluid communication from annulus 43 and the BOP annular flow path 23 to drilling fluid return line 62 and a drilling fluid flow rate and pressure regulating device 110.

To regulate the flow rate and pressure of the drilling fluid 52 while it flows in the borehole 32, regulating device 110 is assisted by a pressure sensor, such as the pressure sensor 112 proximal the discharge coupling 72, the downhole pressure sensor 15, or both sensors 15, 112. In other embodiments, the sensor (e.g., sensor 112) may be replaced or augmented with a flow rate sensor so that the flow rate of drilling fluid 52 passing into drill string 8 or out from annulus 43 may be more directly monitored and controlled. In this embodiment, regulating device 110 is a choke valve, and thus, may also be referred to herein as control valve or choke valve 110. A processor and control modules coupled to or contained within control system 38 govern the operation of control valve 110.

During drilling operation, the mud 52 (drilling fluid) passes from the mud pump 56 into the drill string 8 via fluid line 58, rotatable coupling 60, and kelly 10. The mud 52 is discharged through nozzles in the drill bit 14 into the bottom of the borehole 16, and then flows back to the surface 25 via annulus 43. The pressure of mud 52 in annulus 43 controls or influences the flow of fluids (mud 53 and formation fluids) between annulus 43 and the formation zones 26, 27. At the surface 25, the mud 52 exits annulus 43 via flow path 23 through BOP 20 and control valve 22, and then flows through the return line 62, control valve 110, and a solids control system 61 to tank 54. The solids control system 62 separates solids (e.g., formation cuttings) from the mud 52, and may include hardware such as shale shakers, centrifuges, and automated chemical or solids additive systems.

The fluid pressure in annulus 43 is a function of the weight or density of the drilling fluid in annulus 43 (hydrostatic head) and the movement of drilling mud 52 or formation fluids (i.e. fluids held in earthen formations or zones). In general, the pressure for a selected location in a borehole, for example at the location of pressure sensor 15 in BHA 13, includes at least two components as follows:

$$P=P_{HS}+P_{dyn} \qquad \text{Equation 1}$$

where:

- P=the downhole or annulus pressure, also called "total pressure" (may be expressed in pascals or psi);
- $P_{HS}$=the hydrostatic pressure due to the weight of the drilling fluid in annulus 43 accumulated above the selected location (may be expressed in pascals or psi); and
- $P_{dyn}$=the dynamic pressure required to overcome frictional losses due to the flow of fluid in the annulus 43 (may be expressed in pascals or psi).

Equation 1 pertains, for example, to downhole pressure sensor 15, which is configured to measure the pressure in borehole 16 in the vicinity of drill bit 14, that is to say, the pressure of the mud 52 within the annulus 43. The hydrostatic pressure, $P_{HS}$, in borehole 16 may be measured by sensor 15 while mud 52 in the annulus 43 is not circulating but is static, for example, when mud pump 56 is not active causing the dynamic pressure, $P_{dyn}$, to have a value of zero.

The hydrostatic pressure, $P_{HS}$, at a selected location (for example the current location of sensor 15) is proportional to the vertical depth of that location, the average density of the mud above that location, and the average gravitational acceleration acting on the mud above that location. A relationship for hydrostatic pressure, $P_{HS}$, is:

$$P_{HS}=g*\rho*D \qquad \text{Equation 2}$$

where:

- D=the vertical depth at the selected location, also called true vertical depth or simply, "depth" (may be expressed in meters or feet);
- ρ=average density of the mud above the selected location (may be expressed in $kg/m^3$ or psi); and
- g=average gravitational acceleration acting on the mud above the selected location (may be expressed in $m/s^2$ or $ft/s^2$).

For example of sensor 15, the depth D is determined from length along drill string 8 or by any method known in the art. While sensor 15 is capable of measuring hydrostatic pressure, Equation 2 states that hydrostatic pressure, $P_{HS}$, at the location of sensor 15, for example, can be calculated from known or estimated values of mud specific weight and the corresponding depth D. Similarly, hydrostatic pressure can be calculated for any known depth if mud specific weight is known or estimated. As with all variables, parameters, properties, and equations used herein, any set of appropriate and consistent set of engineering units known in the art may be applied. For some sets of units, additional conversion factors may be required to achieve or to maintain consistency.

The average density of mud within borehole 16 is influenced by and may vary according to at least these factors: (a) changes made to the mud 52 disposed in tank 54, (b) the generation rate of cuttings by drill bit 14, and (c) density variations of the cuttings as drill bit 14 passes through various subsurface formations, such formations 26 to 27, for example. The mud density in annular space 43 may also increase or decrease due to one or more of these factors or other circumstances such as: (a) intrusion of formation fluids and (b) the loss of a liquid constituent from the mud to a porous formation.

While drilling mud is pumped down drill string 8 and back up annulus 43, the fluid pressure within circulation system 50 increases as the mud pump 56 works to overcome frictional losses as mud 52 flows through the center of drill string 8, exits drill bit 14, and returns axially through borehole annular space 43, possibly with the addition of cuttings. This increase in pressure due to the flow of mud 52 is the dynamic pressure, $P_{dyn}$, as described above in Equation 1.

The value of dynamic pressure is based on the length and nature of the flow path located downstream of a selected location of interest. For example, a pressure sensor 65 located near the discharge of the mud pump 56 measures the entire frictional pressure drop due to mud traveling through fluid supply line 58, through drill string 8, up annular space 43, through return line 62. Additional frictional losses may be sensed 65 depending on the flow path required to reach the solids control system or mud tank 54. Due to its location above earth's surface 25, as shown in FIG. 1, sensor 65 measures no hydrostatic pressure associated with the borehole. As a second example, pressure sensor 15 disposed on drill string 8 within borehole 16 will sense the dynamic pressure that is required to overcome only those frictional losses that occur beyond the sensor 15 as drill fluid circulates. Sensor 15 does not sense or measure the frictional loses that occur in the drill string 8 prior to the drilling fluid arriving at sensor 15. In addition, sensor 15 will sense the hydrostatic pressure corresponding to its depth, D. The dynamic pressure sensed by sensor 15 results from the frictional losses in the portion of annular spaces 43, 23, 73 located between sensor 15 and return line 62 and the frictional losses due to control valve 110. Additional frictional losses may be sensed by sensor 15 depending on the flow path required to reach the solids control system or mud tank 54.

Equivalent circulating density (ECD) is an industry convention for normalizing downhole pressure. That is to say, ECD is a normalized form of total pressure (Equation 1) in mud 52. Using conventional techniques, equivalent circulating density is calculated as pressure divided by the depth at the location of the pressure measurement. The formula for calculating equivalent circulating density is:

$$ECD = \frac{P}{g * D} \qquad \text{Equation 3}$$

With Equation 1 Substituted into Equation 3:

$$ECD = \frac{P_{HS} + P_{dyn}}{g * D} \qquad \text{Equation 4}$$

Depending on the amount of information desired, ECD may be calculated according to Equation 4 periodically during the operation of well system 1. Evaluated periodically, ECD may be used by an operator or by drilling control system 38 to govern the operation of drilling system 1 to maintain the downhole pressure within a targeted range. As an example, ECD may have units of $kg/m^3$ or psi.

Figure 2:
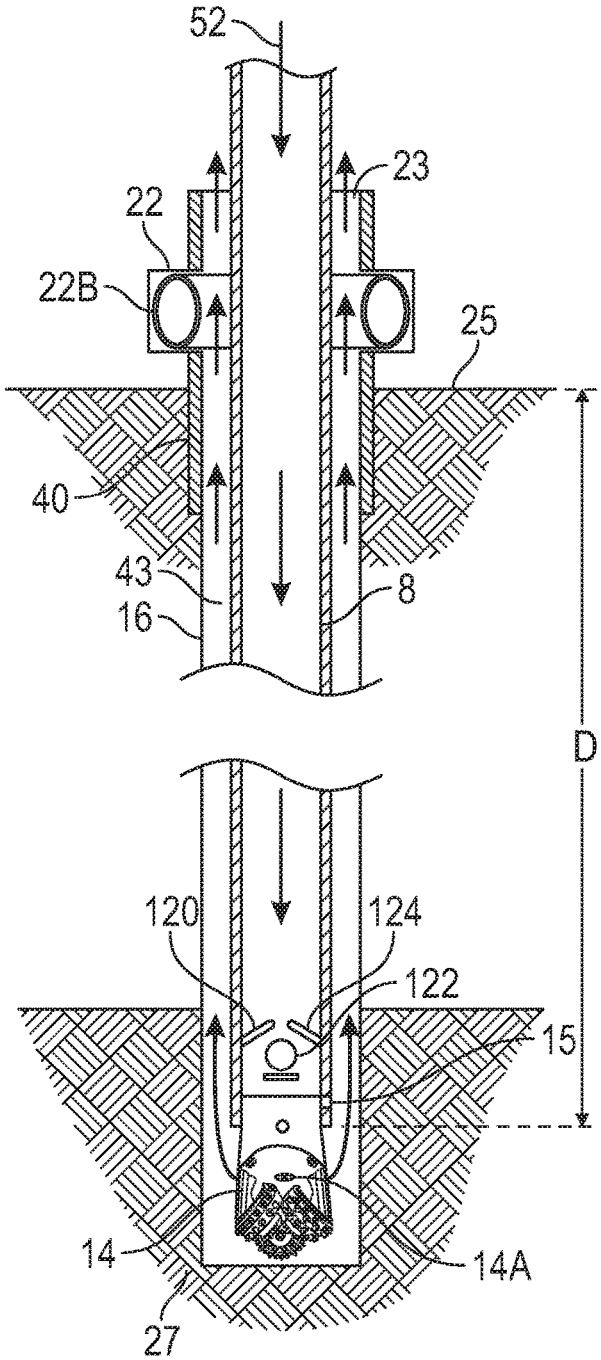
FIG. 2 is an enlarged partial view of the drilling system of FIG. 1 with the annular flow path in the borehole "open;"

Referring now to FIG. 2, an enlarged partial view of drilling system 1 with control valve 22 "open" is shown. With control valve 22 open, the fluid flow path 23 and annulus 43 may also be described as open since fluid communication between annulus 43, flow path 23, discharge coupling 72, and return line 62 is provided. In FIG. 2, drill string 8 is shown partially in cross-section, revealing a check valve 120 located within the drill string proximal its lower end adjacent drill bit 14. Valve 120 is configured to allow one-way flow of drilling fluid down the drill string and out the bit 14 through nozzles 14*a* in the face of bit 14. In this example, valve 120 is a float valve having a captured ball 122 that is configured to move downward away-from a seat 124 when mud flows downward through drill string 8 and is configured to move upward toward seat 124 if the flow of fluid in drill string 8 attempts to move in the reverse direction. Thus, when drilling fluid circulates down drill string 8 and up annulus 43, valve 120 remains open, however, when circulation of drilling fluid down drill string 8 or up annulus 43 ceases, valve 120 closes. In the schematic view shown in FIG. 2, control valve 22 is represented as an annular valve having an expandable tubular member 22B with a toroidal shape for sealing against the outside of tubular string 8. To allow mud 52 to flow, check valve 120 is open, and control valve 22 is open (e.g., tubular member 22B is at least partially collapsed and not fully expanded).

Figure 3:
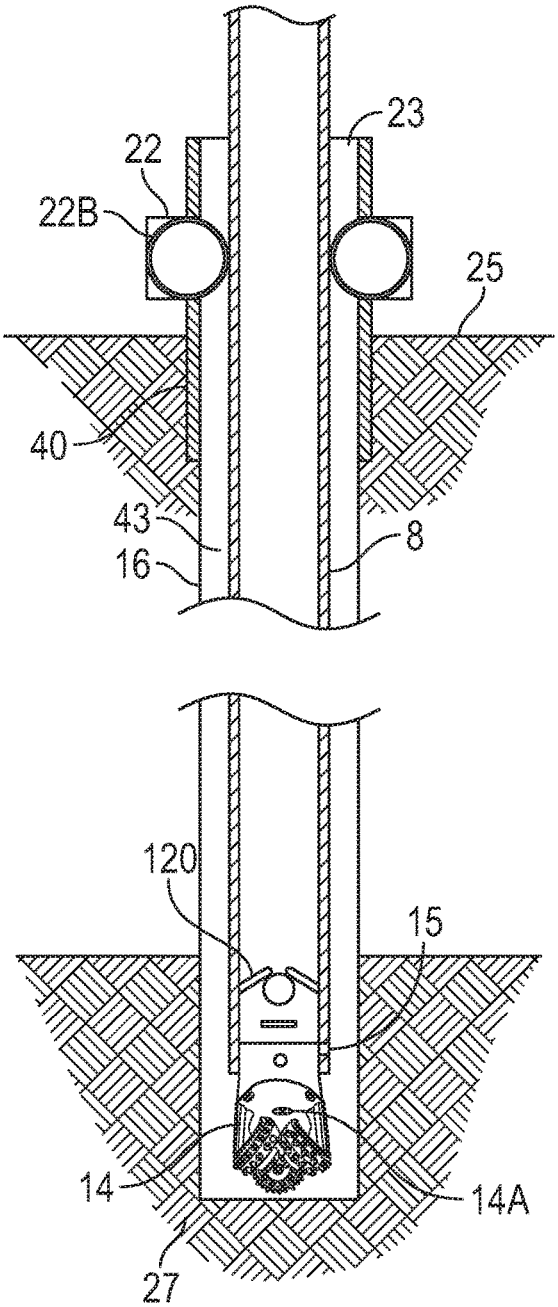
FIG. 3 is an enlarged partial view of the drilling system of FIG. 1 with the annular flow path in the borehole "closed;"

Referring now to FIG. 3, an enlarged partial view of drilling system 1 with control valve 22 "closed" is shown with tubular member 22B radially expanded into contact with tubular string 8. With control valve 22 closed, the fluid flow path 23 and annulus 43 may also be described as closed since fluid communication between annulus 43 and discharge coupling 72 (FIG. 1) is prevented by valve 22. With control valve 22 closed, fluid flow through annulus 43 and drill string 8 is stopped. As a consequence, check valve 120 closes provided the formation pressure exceeds the hydrostatic head of the fluid in borehole 16 and attempts to push fluid into drill string 8. The mud 58 within annulus 43 (possibly including cuttings and formation fluids from a surrounding earthen zone) is captured and contained between check valve 120 in drill string 8 and control valve 22. Depending on when valves 120, 22 were closed as compared to when pump 56 was shut-off, valves 120, 22 capture and contain at least a portion of the pressure that mud 52 had while flowing, i.e. at least a portion of the dynamic pressure of Equation 1, and the fluid continues to exert hydrostatic pressure.

Figure 4:
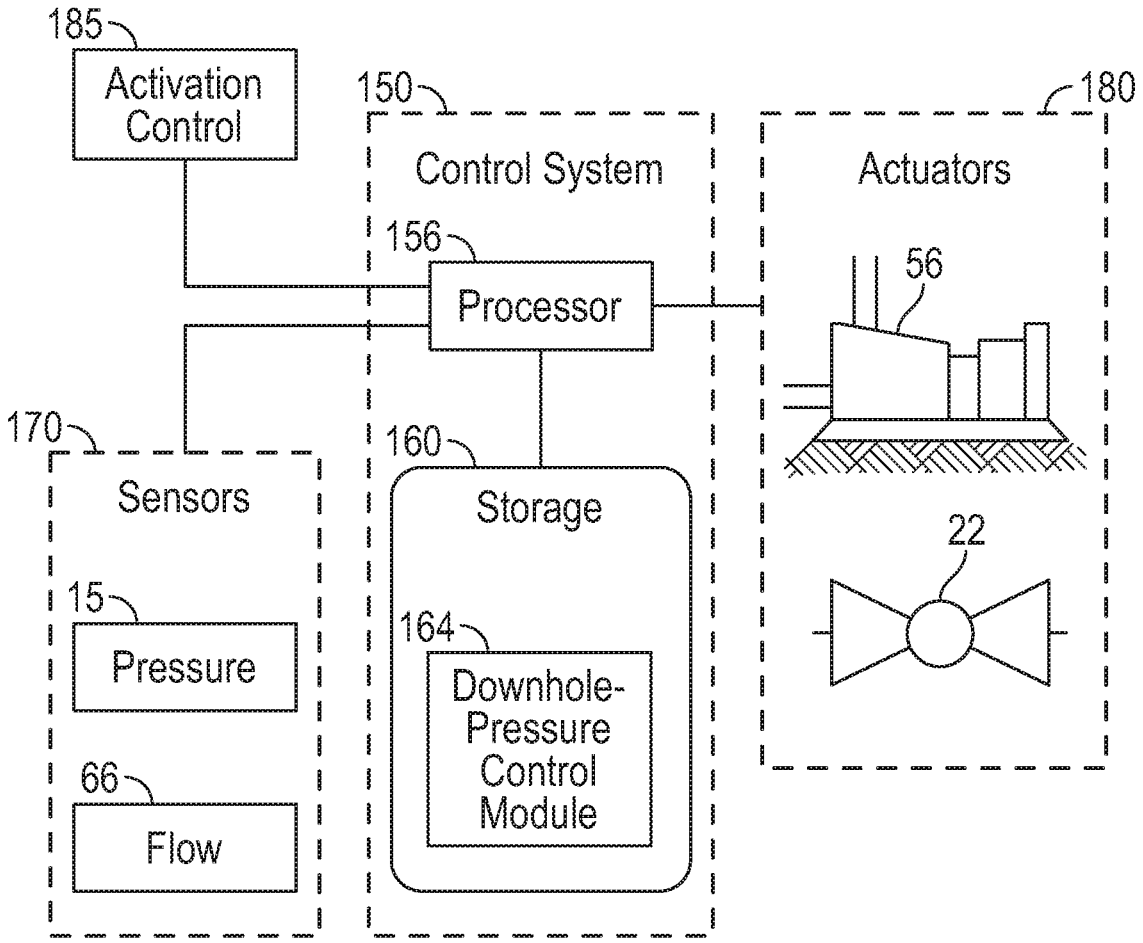
FIG. 4 is a schematic block diagram of an embodiment of a processing system for controlling the fluid pressure in a borehole using the system of FIG. 1 in accordance with principles disclosed herein.

Referring now to FIG. 4, a block diagram illustrating the fluid pressure control system 150 and connections thereto is shown. As will be described in more detail below, the operation of valve 22 is controlled with fluid pressure control system 150 to manage the pressure of drilling fluid in the annulus 43. Fluid pressure control system 150 is coupled to one or more sensors 170, to one or more actuators 180, and to an activation control switch 185. In this embodiment, system 150 includes a processor 156 and storage 160.

Processor 156 may be a general-purpose microprocessor, digital signal processor, microcontroller, or other device capable of executing instructions retrieved from a computer-readable storage medium. Processor architectures generally include execution units (e.g., fixed point, floating point, integer, etc.), storage (e.g., registers, memory, etc.), instruction decoding circuitry, peripherals (e.g., interrupt controllers, timers, direct memory access controllers, etc.), input/output systems (e.g., serial ports, parallel ports, etc.) and various other components and sub-systems.

As understood by those skilled in the art, processors execute software instructions. Software instructions alone are incapable of performing a function. Therefore, in the present disclosure, any reference to a function performed by software instructions, or to software instructions performing a function is simply a shorthand means for stating that the function is performed by a processor executing the instructions.

The storage 160 is a non-transitory computer-readable storage medium suitable for storing instructions executable by the processor 156, and for storing measurements received from the sensors 170, calculate results, such as pressure, ECD, etc., and other data. The storage 160 may include volatile storage such as random access memory, non-volatile storage (e.g., a hard drive, an optical storage device (e.g., CD or DVD), FLASH storage, read-only memory), or combinations thereof.

The storage 160 includes a downhole-pressure control module 164. This module includes instructions that when executed cause the processor 156 to perform the operations disclosed herein. For example, the instructions included in the module 164, when executed, may cause the processor 156 to perform the operations of a method 300 that is discussed below or other operations disclosed herein.

The sensors 170 that couple to the control system 150 include downhole pressure sensor 15 and mud flow sensor 66. The actuators 180 that couple to the control system 150 include control valve 22 and pump 56. In various embodiments, the activation control switch 185 may be a manual switch or button, an electronic button or switch, or a control module implemented from storage 160 at the command of drilling control system 38, for example. Switch 185 configures the control system 150 to be controlled by an operator or by drilling control system 38. Though described as a passive member, check valve 120 at the bottom of drill string 8 participates in the functionality implemented by control system 150.

In some embodiments, sensors 170 may include pressure sensor 112, pressure sensor 65, or a pressure sensor positioned to measure the pressure in annulus 43 immediately below valve 22, as examples. In some embodiments, actuators 180 include control valve 110 (FIG. 1). Control valve 110 may assist or replace the annular seal member 22 for controlling or retaining pressure downhole when pump 56 is deactivated or drilling fluid is not flowing in borehole 16. For example, in some embodiments, processor 156 directs control valve 110 to perform the functions and to achieve the open and closed states attributed to seal member/valve 22, such as are shown in FIG. 2 and FIG. 3.

Figure 5:
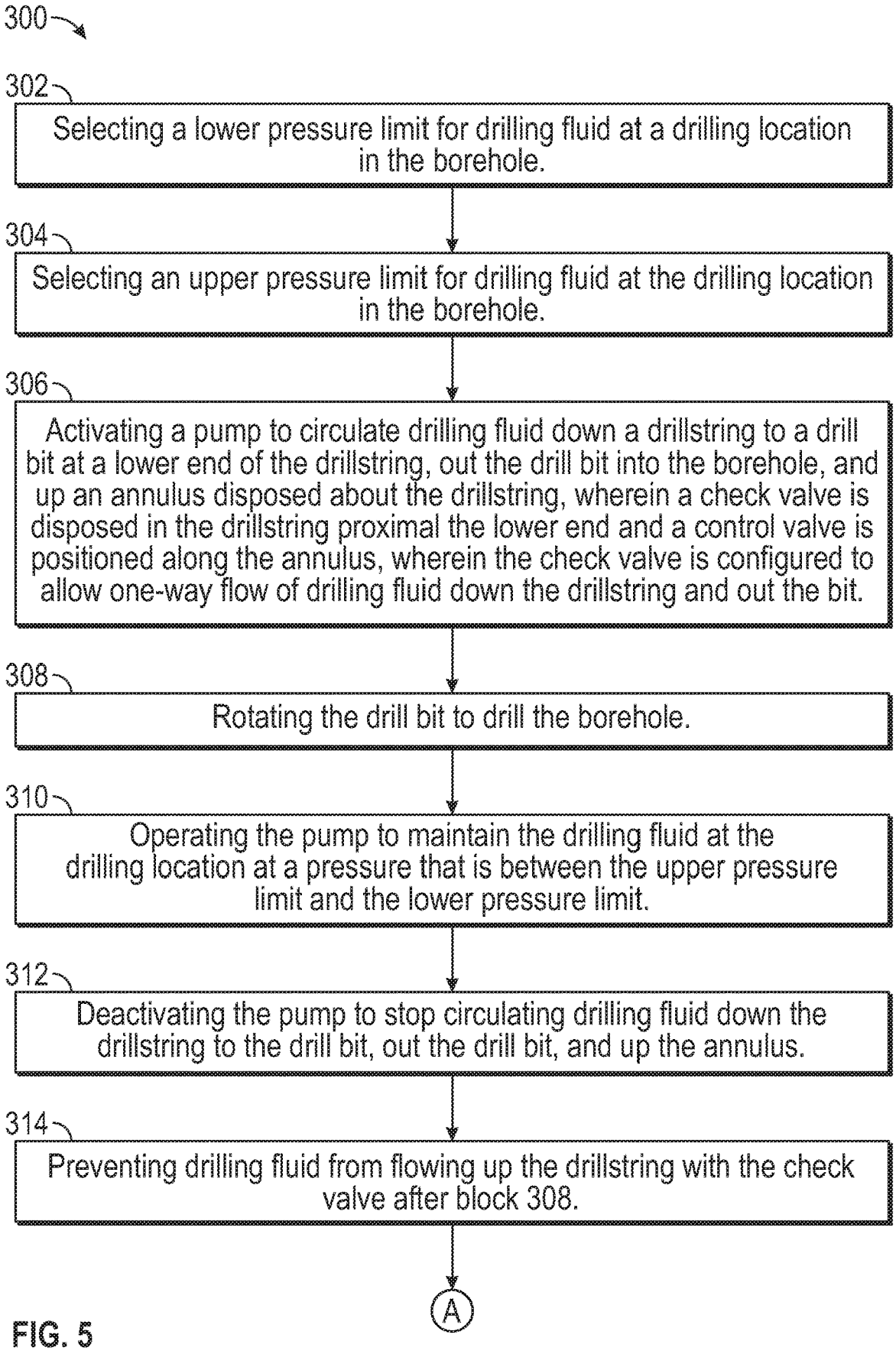
FIG. 5 is a schematic block diagram of an embodiment of a method for controlling the fluid pressure in a borehole in accordance with principles disclosed herein, as may be implemented, for example, with the system of FIG. 1.
Figure 6:
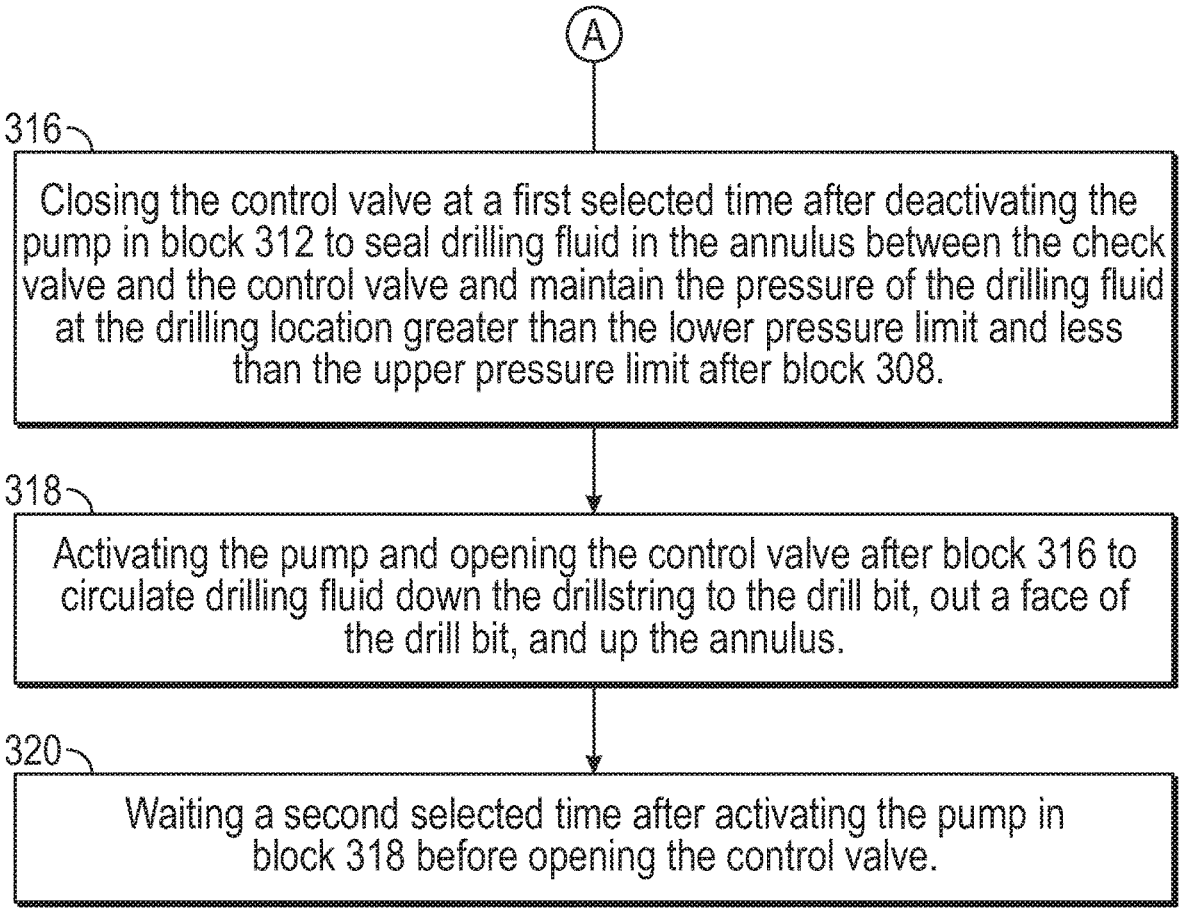
FIG. 6 is a continuation of the schematic block diagram of FIG. 5, as indicated by the connector "B;"
Figure 7:
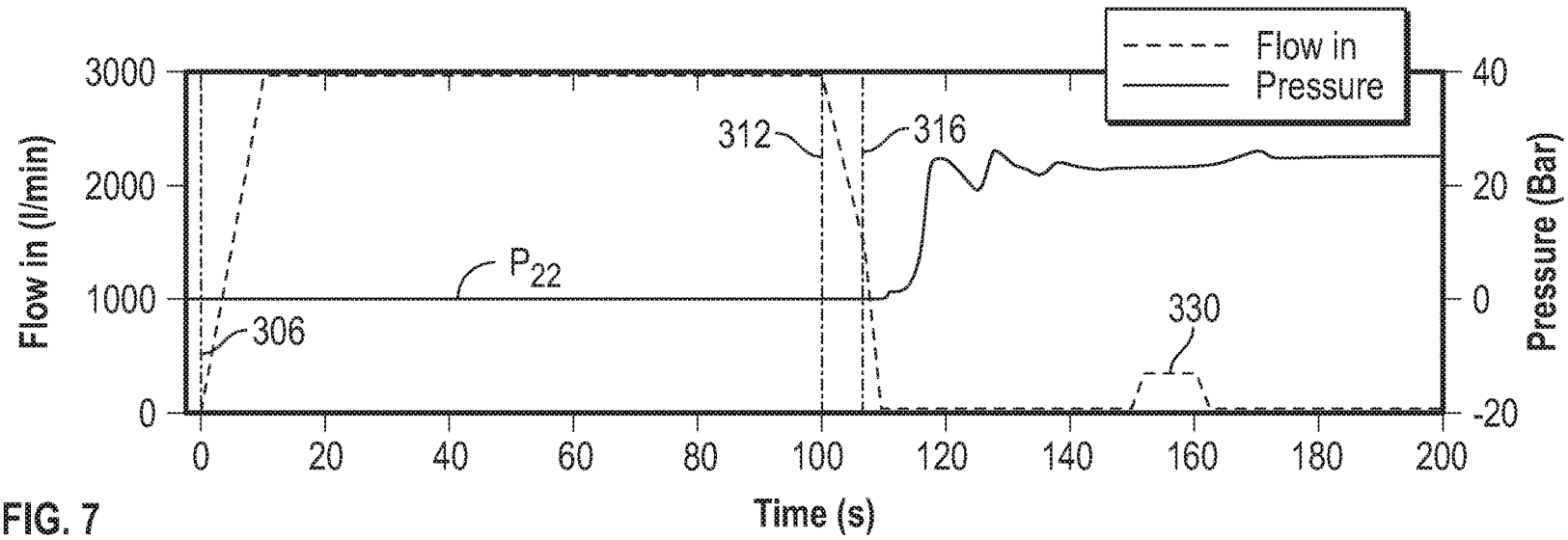
FIG. 7 is a data graph showing the flow rate of drilling fluid from the pump in the system of FIG. 1 during an exemplary period of operation in accordance with principles described herein.
Figure 8:
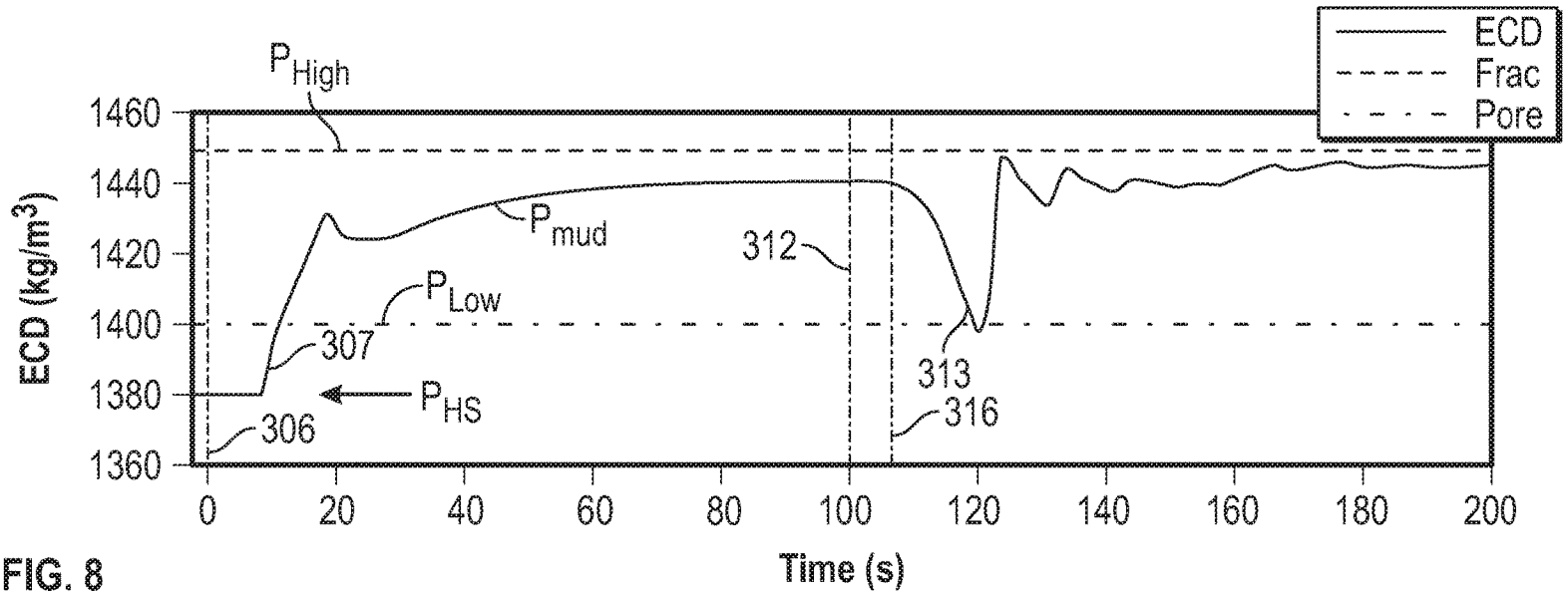
FIG. 8 is a data graph showing a lower and an upper pressure limit and the mud pressure at a selected drilling location during the same exemplary period shown in FIG. 7.

Referring now to FIG. 5 and FIG. 6, a method 300 for controlling drilling fluid pressure in annulus 43 of drilling system 1 with drilling control system 38 and fluid pressure control system 150 is shown. FIG. 7 and FIG. 8 are graphs illustrating exemplary results of implementing method 300. Beginning at block 302 in FIG. 5, method 300 includes selecting a lower pressure limit for a drilling fluid at a drilling location in the borehole (e.g. a pressure limit that is applicable to a portion of the drilling fluid while that portion is located at or passes through the drilling location). The selected drilling location may be the current or a future drilling location (e.g., a deeper location within the formation 27). In block 304, method 300 includes selecting an upper pressure limit for the drilling fluid at the drilling location in the borehole. In general, "the drilling location" in the borehole may be selected from any of the following: a location along drill bit 14, the bottom of drill bit 14, a location along BHA 13, the location of pressure sensor 15, or another location along drill string 8 at which location the downhole pressure in borehole 16 may be measured or estimated. For convenience in the current discussion, the drilling location will be selected to be the location of pressure sensor 15, and the measured or estimated pressure data pertaining to sensor 15 will be indicated as $P_{mud}$. The relationship for total pressure, P, in Equation 1 pertains to the drilling mud pressure $P_{mud}$. In embodiments described herein, the lower pressure limit selected in block 302 is preferably greater than or equal to the pore pressure in borehole 16, thereby restricting and/or preventing the influx of formation fluids into annulus 43. The upper pressure limit selected in block 304 is preferably less than or equal to the formation fracture pressure at the current drilling location or another location along the borehole, thereby reducing and/or eliminating the risk of inadvertently fracturing the formation. FIG. 8 is graph that displays a lower pressure limit of pressure, $P_{low}$, that is selected to be equal to the pore pressure at the depth D of pressure sensor 15 at the bottom of drill string 8, which corresponds to the current drilling location depicted in FIG. 2. Pore pressure includes the pressure of a formation fluid, if any, contained in the adjacent earthen zone, such as zone 27. The pressure data of FIG. 8 are presented as normalized pressure, that is to say: ECD per Equation 3. In FIG. 8, an upper pressure limit, $P_{high}$, is selected to be equal to the formation fracturing pressure of the earthen zone 27 at the current drilling location. The desired or preferred range of pressures that extends from $P_{low}$ to $P_{high}$ is an operating range selected for the pressure, $P_{mud}$, of drilling mud at the drilling location. This range is also called the targeted range.

Referring again to FIG. 5, block 306 includes activating mud pump 56 to circulate drilling fluid 52 down the drill string 8 to the drill bit 14, out the drill bit 14 into the borehole, and up the annulus 43. With drilling fluid circulating through circulation system 50, check valve 120 and control valve 22 are both open as shown in FIG. 2. FIG. 7 shows pump 56 activated at T=2 seconds, causing the flow rate of mud 52 into the drill string 8 to rise from a zero flow condition. As shown in FIG. 8, prior to activating pump 56, the initial pressure of the drilling fluid, $P_{mud}$, at the drilling location (for example measured by sensor 15 and converted to ECD) is the hydrostatic pressure, $P_{HS}$, having an exemplary value of 1380 [kg/m$^3$], which is undesirably less than the lower pressure limit, $P_{Low}$, in this example. However, after pump 56 begins to push drilling fluid 52 to the drilling location, the pressure at the drilling location, $P_{mud}$, includes dynamic pressure in addition to hydrostatic pressure, per Equation 1, causing the pressure to rise, indicated by reference numeral 307. This initial rise in pressure at 307 is delayed after pump 56 starts. Without being limited by this or any particular theory, the delay in the rise in pressure at 307 may be due to one or more possible factors including, without limitation, the sonic speed in the mud fluid, the compression that develops in the mud, compression that develops in the formation fluids within porous structures surrounding the exposed portions of borehole 16 (where casing has not been installed, for example, at the bottom), or flexibility or porosity of the material forming the exposed portions of the bore, as examples. When pump 56 is active and mud 52 is flowing, the pressure of the drilling fluid 52 within drill string 8 and within annulus 43 includes hydrostatic pressure, $P_{HS}$, and dynamic pressure, $P_{dyn}$, as expressed in Equation 1 and, alternatively, in Equation 4, above. For example, when mud 52 is flowing at the bottom of borehole 16, the pressure of the drilling fluid at the drilling location, $P_{mud}$, includes non-zero values for hydrostatic pressure and for dynamic pressure. System 1 is configured and method 300 is operated so that pressure of the drilling fluid at the drilling location rises above the lower limit, $P_{low}$, when pump 56 is active. In some instances when block 306 is implemented, the initial pressure of the drilling fluid will be greater than $P_{Low}$.

Referring again to FIG. 5, block 308 of method 300 includes rotating drill bit 14 to drill the borehole 16, which causes depth D to increase, moving the drill bit and the drilling location deeper into the earth. Moving now to block 310, method 300 includes operating the pump 56 to maintain drilling fluid 52 at the drilling location at a pressure that is between the upper pressure limit, $P_{high}$, and the lower pressure limit, $P_{Low}$, as selected in blocks 302, 304 previously described.

In FIG. 8, during the operating period that includes T=15 and T=100, the pressure, $P_{mud}$, at the drilling location remains within the targeted range between $P_{low}$ and $P_{high}$. This condition is maintained by drilling control system 38 through adjustments to the speed of mud pump 56 or by increasing or decreasing a flow opening within control valve 110 (FIG. 1), as examples. In addition, changes to the composition of mud 65 may be made to influence its average density and hence its hydrostatic pressure at the depth D to keep the fluid pressure within targeted range while pump 56 is active.

Referring again to FIG. 5, in block 312, pump 56 is deactivating to stop circulating drilling fluid 52 down the drill string 8 to the drill bit 14, out the drill bit, and up the annulus 43. Pump 56 may be deactivated to make changes to system, such as adding or removing a section of drill pipe 18 or to adjust or clean portions of fluid circulation system 50, as examples. While pump 56 may be deactivated abruptly, it is anticipated that the speed of pump 56 will be ramped down at a prescribed rate to reach a zero flow condition. Even if pump 56 is deactivated abruptly by withdrawal of power, the inertia of pump 56 or the mud 52 may cause the flow of mud in borehole 16 to ramp down to zero rather than to stop promptly. The approximate time when block 312 is implemented is shown on the graphs of FIG. 7 and FIG. 8. After this event, flow rate of mud 52, as measured by flow sensor 66 for example, declines. Shown in FIG. 8, the drilling fluid pressure at sensor 15 (the drilling location), $P_{mud}$, initially remains steady and then begins to decline due to a progressive loss of dynamic pressure, $P_{dyn}$ (Equation 1). The decline of mud total pressure, $P_{mud}$, is indicated by reference numeral 313 and lags behind the pump 56 shut-off event because pump 56 and sensor 15 are physically separated by a considerable distance, for example, by the length of the borehole. Without being limited by this or any particular theory, the delay or lag in the decline of $P_{mud}$ may be due to one or more dynamic factors including, without limitation, the sonic speed in the mud fluid, inertia of the mud flow, an initial re-expansion of the compression mud, an initial re-expansion of the formation fluids within porous structures surrounding the exposed portions borehole (where casing has not been installed), and flexibility in the material surrounding exposed portions of the bore, as examples.

Referring again to FIG. 5 and now block 314, after the circulation of drilling fluid 52 (i.e. mud) ceases following the deactivation of pump 56 and check valve 120 closes, thereby preventing the drilling fluid from flowing up the drill string 8. Moving now to block 316 in FIG. 6, the control valve 22 is closed at a selected time after deactivating the pump 56 in block 312 to seal or capture drilling fluid in the annulus 43 between the check valve 120 and the control valve 22, thereby maintaining the pressure of the drilling fluid at the drilling location greater than the lower pressure limit and less than the upper pressure limit after block 308. FIG. 3 depicts a condition that results from blocks 314, 316 with both valves 22, 120 closed. The approximate time when block 316 is implemented is shown on the graphs of FIG. 7 and FIG. 8. One reason for closing valve 22 after deactivating pump 56 and after fluid flow begins to decline is to reduce the wear of valve 22 caused by the flow of mud 52, which is an abrasive fluid. Control valve 22 may be closed abruptly or may be closed more slowly, over a selected period of time, to avoid a possible spike in pressure or to reduce the wearing of valve 22. In the example of FIG. 8, the closing of the check valve 120 and control valve 22 (see reference numeral 316) occur before all or before a majority of the decline of the mud pressure, $P_{mud}$, indicated as event 313.

As a consequence of the events of blocks 312, 314, 316, the flow rate of mud 52 declines and comes to a stop, and the drilling fluid pressure at sensor 15, $P_{mud}$, begins to decline (time T=110), due to the resulting loss of dynamic pressure, $P_{dyn}$. However, the closed valves 22, 120 retain sufficient pressurized (and possibly compressed) fluid in annulus 43 to prevent the drilling fluid pressure from dropping to the lower pressure limit, $P_{low}$, or to the hydrostatic pressure of that fluid. As shown in FIG. 8, the drilling fluid pressure, $P_{mud}$ (shown as ECD), eventually begins rise again (at T=120), possibly due to the re-expansion of the mud 52 as it comes to rest (flow rate of zero in annulus 43). Over time, the drilling fluid pressure stabilizes and, at least for this example, it stabilizes at a value similar to the pressure value achieved when the fluid was being pumped (compare ECD data for T=170–200 against data for T=70–95). The selected timing of closing control valve 22 accounts for the fluid compressibility and its re-expansion in order to avoid overshooting the upper pressure limit. Due to the sequence and timing of the events of blocks 312, 314, 316, the drilling fluid pressure in annulus 43 remains within the targeted range (greater than or equal to $P_{low}$ and less than or equal to $P_{high}$) even after shutting-off pump 56. It is conceived, that the timing of the events of blocks 312, 314, 316 may be adjusted to achieve time-variations in the flow rate and pressure that differ from those shown in FIG. 7 and FIG. 8 while remaining within the targeted range of pressure. Some implementations of method 300 may, purposefully or unintentionally, result in temporary excursions of drilling fluid pressure outside the targeted range.

In addition to the flow rate of mud 52, FIG. 7 also includes a pressure trend representative of the pressure of the mud within annulus 43 adjacent the control valve 22, indicated by the reference numeral $P_{22}$ (this pressure is measured or calculated). Since this location is above ground, the pressure $P_{22}$ is plotted in engineering units (in this case: Bar), not as ECD. For the example plot of FIG. 7, the flow path from the exit of control valve 22, past sensor 112, and through discharge line 62 is assumed to have a pressure drop of zero. Since control valve 22 effectively has no fluid head above it and no pressure drop beyond it, at least in this example, $P_{22}$ is zero while mud is pumped by pump 56 from the event of block 306 and $P_{22}$ continues to be zero up to the event of block 316, which are shown on the left side of FIG. 7.

Considering the pressure $P_{22}$ in view of Equation 1, both the hydrostatic and the dynamic components of pressure $P_{22}$ are zero on the left side of FIG. 7. After valve 22 is closed at the event of block 316, the pressure $P_{22}$ begins to rise as the mud flow comes to a stop and expands.

Also in the example of FIG. 7, while control valve 22 and check valve 120 are closed, a by-pass flow path from pump 56 to annulus 43 or a separate a pressure control pump coupled for fluid communication with annulus 43 replenishes some of the mud (drilling fluid) in annulus 43. This replenishment flow 330 is shown as a temporary flow of mud in the time period from 150 to 160 seconds. A replenishment flow of mud into annulus 43 may be used frequently or infrequently based on the porosity and fluid pressure of the formation where casing 40 is absent downhole.

Continuing to reference FIG. 6, at least some embodiments method 300 proceed to a block 318 that includes activating the pump 56 and opening the control valve 22 after block 316 to circulate drilling fluid down the drill string 8 to drill bit 14, out the drill bit, and up the annulus 43. In at least some of these embodiments, method 300 includes to a block 318 wherein the operation of opening the control valve 22 is performed at a selected time after activating the pump 56 to maintain the pressure of drilling fluid 52 at the drilling location greater than the lower pressure limit and less than the upper pressure limit while restarting the flow of drilling fluid 52. These actions may be performed in order to prepare for re-starting the drilling process, i.e. to start rotating bit 14 again, for example.

Without being limited by this or any particular theory, a description is provided herein below as a basis for a pressure simulation model that may be used to demonstrate how the disclosed pressure control method may function in practice. The model may be solved numerically, by a computer for example.

The pressure of drilling mud inside a drill string can be formally written as:

$$p_i(s) = p_i(0) + \int_0^s (\rho g \cos\theta - \rho a_i - p_i')ds \qquad \text{Equation 5}$$

where s is the arc length of the drill string, referenced to the top of the drill string (commonly called measured depth), ρ is the density of the circulating fluid, g is the acceleration of gravity, $a_i$ is the acceleration of inner fluid (positive downward, in normal flow direction), θ is the well bore inclination angle (deviation from vertical), and $p_i'$ is the flow induced pressure gradient (frictional pressure drop per unit length).

Similarly, the annular pressure can be written as:

$$p_a(s) = p_a(0) + \int_0^s (\rho g \cos\theta + \rho a_a + p_a')ds \qquad \text{Equation 6}$$

The sign shift in the last integrand term comes from the fact that the normal annular flow direction is upwards so that the inertial and frictional pressure drop adds to the hydrostatic term.

The frictional pressure loss gradients are functions of flow rate, flow cross section area, temperature, pressure, and fluid rheology. The fluid acceleration can be written as $$a = \frac{\partial v}{\partial t} = \frac{1}{\rho\kappa}\int_0^t \frac{\partial^2 v}{\partial s^2}dt = c^2\int_0^t \frac{\partial^2 v}{\partial s^2}dt \qquad \text{Equation 7}$$

where ν is the fluid speed (positive in downstream direction), κ is the fluid compressibility, and $c=1/\sqrt{\kappa\rho}$ is the wave propagation speed for pressure waves, hereafter called the sonic speed.

The pressure simulation model described herein represents an integral version of the classical wave equation with a non-linear damping. It can be solved numerically by a finite difference method where the flow loop is approximated by finite number of inertia and spring elements. Details are omitted here but the pressure simulation model generally gives realistic dynamic results for frequencies below its bandwidth limit. This limit is approximately equal to ratio of sonic pressure wave propagation speed to four times the element length. As an example, an element length of 100 m and a sonic speed of 1000 m/s the discrete model bandwidth is about 2.5 Hz.

Assuming that the fluid density and the corresponding hydrostatic pressure component are constant and equal on either side of the pipe wall the total pressure circulating, steady state pressure will be approximately:

$$p_i(0) = \int_0^L (p_i' + p_a')ds + \Delta p_{bit} + p_a(0) \qquad \text{Equation 8}$$

Here $\Delta p_{bit}$ is the lumped pressured drop across the bit nozzles. If a downhole motor and a pulse telemetry measurement-while-drilling (MWD) unit is included in the bottom hole assembly (BHA), then the pressure drop values from these tools should be added as well. In transient situations, when the flow rate and pressures change quickly, it may be beneficial to account for fluid inertia and compressibility.

Assuming, for example, that both the input flow (pump) and the return flow are suddenly and simultaneously stopped, after a short transient period the excess fluid in the flow loop will result in a certain over-pressure in the entire flow loop. This over-pressure can be calculated from the following formula if we know the fluid volumes (flow cross section areas) and pressure profile inside and outside the pipe.

$$\Delta p = \frac{1}{V}\int_0^L (A_i p_i + A_a p_a)ds \qquad \text{Equation 9}$$

Here $$V = V_i + V_a = \int_0^L (A_i + A_a)ds \qquad \text{Equation 10}$$

is the total fluid volume inside the pipe and in the annulus. The corresponding dynamic compression volume between then pump and the closed valve on the return flow is:

$$\Delta V = \kappa V \Delta p = \int_0^L (A_i + A_a)ds \qquad \text{Equation 11}$$

κ being the fluid compressibility. Assuming that static (no flow) target pressure is a fraction ϕ of the steady state dynamic bottom hole pressure prior to stopping the flow, that is:

$$\Delta p_{set} = \phi \int_0^L p'_a ds \equiv \phi \Delta p_a \quad \text{Equation 12}$$

In most cases, because the annular pressure drop is normally much lower than the pressure losses inside the string, $\Delta p > \Delta p_{set}$. It means that the trapped compression volume is too high. This can be avoided if the return flow closing is delayed a time, $\tau_r$:

$$\tau_r = \kappa \frac{\Delta p - \Delta p_{set}}{Q} \quad \text{Equation 13}$$

Q being the steady state flow rate prior to the sudden stop. A negative delay time means that the pump stop must be delayed by the time $\tau_p = -\tau_r$.

Use of the formulas above may assume that the pump and the closing valve have an idealized instantaneous response time. However, these the formulas can be generalized to the cases where the pump and the closing valve (e.g. pump 56 and closing valve 22 of FIG. 1) have finite response times. If both the pump rate and the return flow can be characterized by actuator delay times $t_{p0}$ and $t_{r0}$, respectively, and the ramp down function is linear and characterized by the ramp times $t_{p\downarrow}$ and $t_{r\downarrow}$, then the effective delay time for the closing valve is $$\tau_r = \kappa \frac{\Delta p - \Delta p_{set}}{Q} + t_{p0} - t_{r0} + 0.5(t_{p\downarrow} - t_{r\downarrow}) \quad \text{Equation 14}$$

If the closing valve on the return flow is an annular seal, there is normally a long activation time while its ramp down time is much shorter, that is $t_{r0} >> t_{r\downarrow}$. In contrast, the pump is able to react very quickly to changes in the set speed, unless the minimum ramp down time is set to a relatively long value.

Before describing numerical simulations, it may be useful to consider the pump restart process. Referring briefly to FIG. 1, when the new connection is made up to add one or multiple pipe joints 18 to drill string 8, and drill string 8 is ready to drill again, the previous flow must be re-established to give the same total downhole pressure as before the circulation stopped. One method for resuming the steady state flow may be to apply a similar delay scheme. As an example, if the return flow stop is optimally lagged $\tau_r$=5 s behind the pump stop, the return valve could be opened with a similar delay time. However, simulations show that although the time to reestablish dynamic equilibrium is minimized by this similar delay, the process may not be optimal. The reason is that a delayed opening of the return flow will give a positive spike in the downhole pressure, a spike that might violate the fracture pressure limit of the formation and thereby damage the formation.

Figure 9:
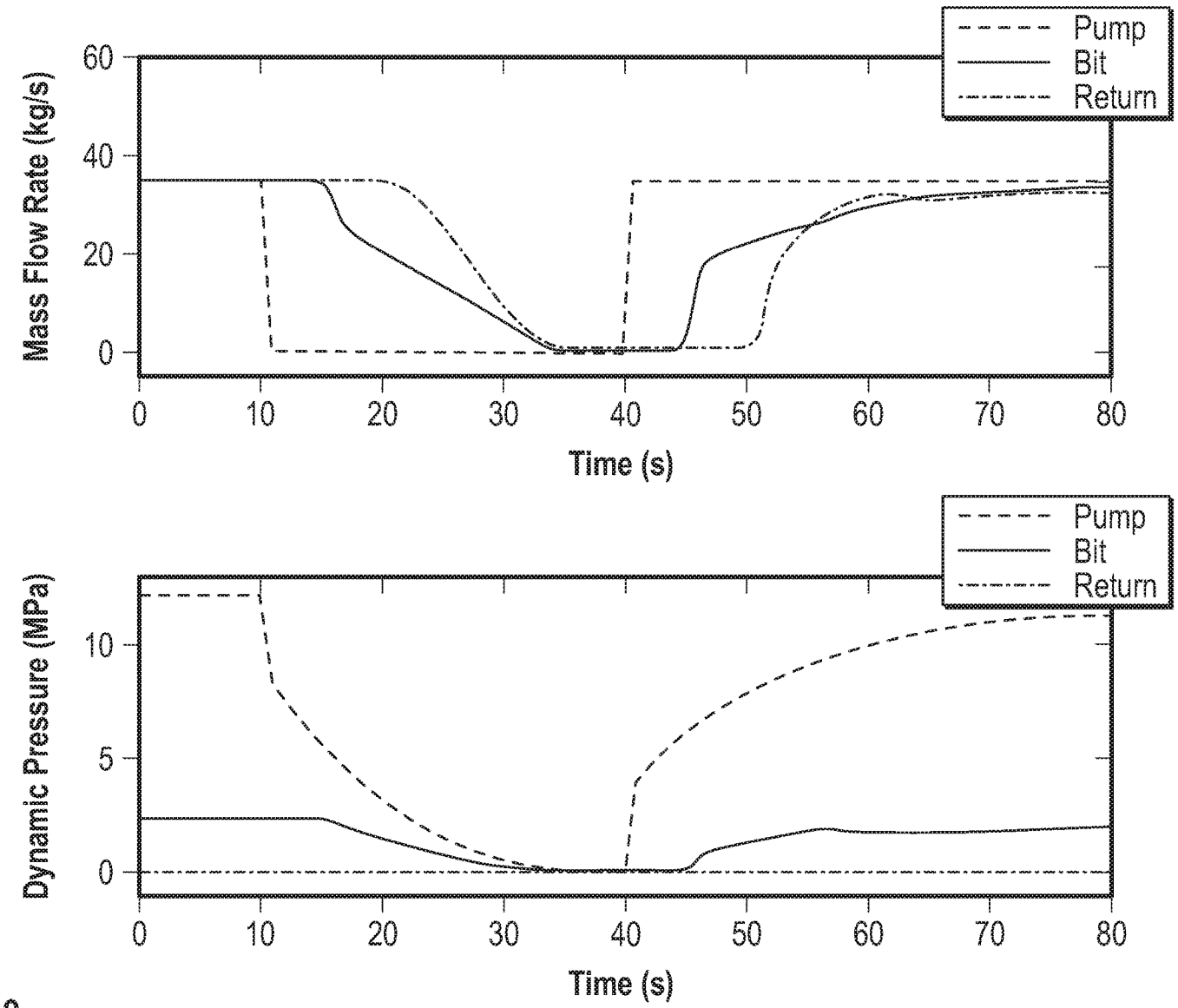
FIG. 9 is a data graph illustrating a simulation of a pump stop and a pump resume cycle without return flow restrictions in accordance with principles disclosed herein.
Figure 10:
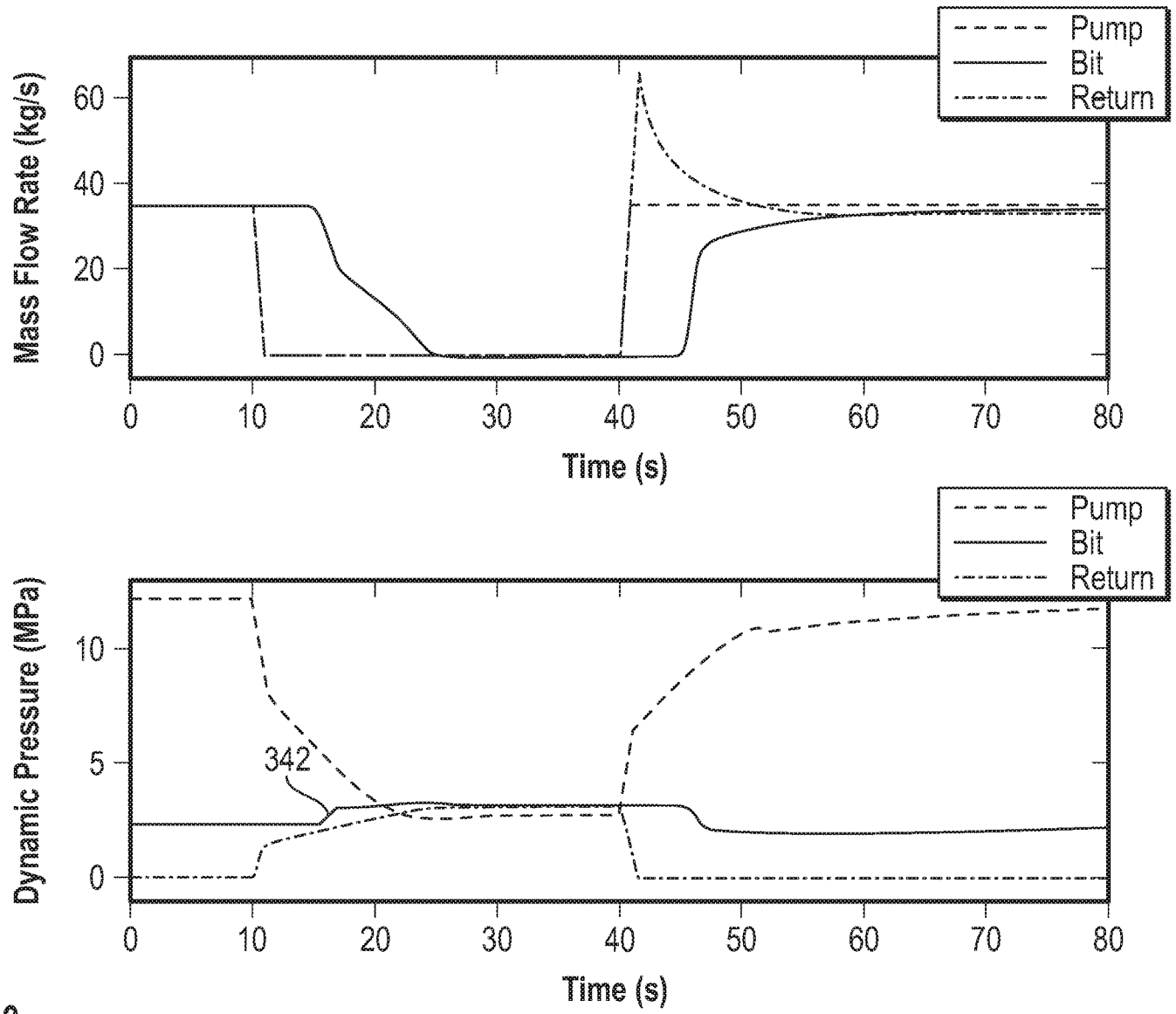
FIG. 10 is a data graph illustrating a simulation of a pump stop and a resume cycle with a synchronous control of the return flow (no time delay of the return flow) in accordance with principles disclosed herein.
Figure 11:
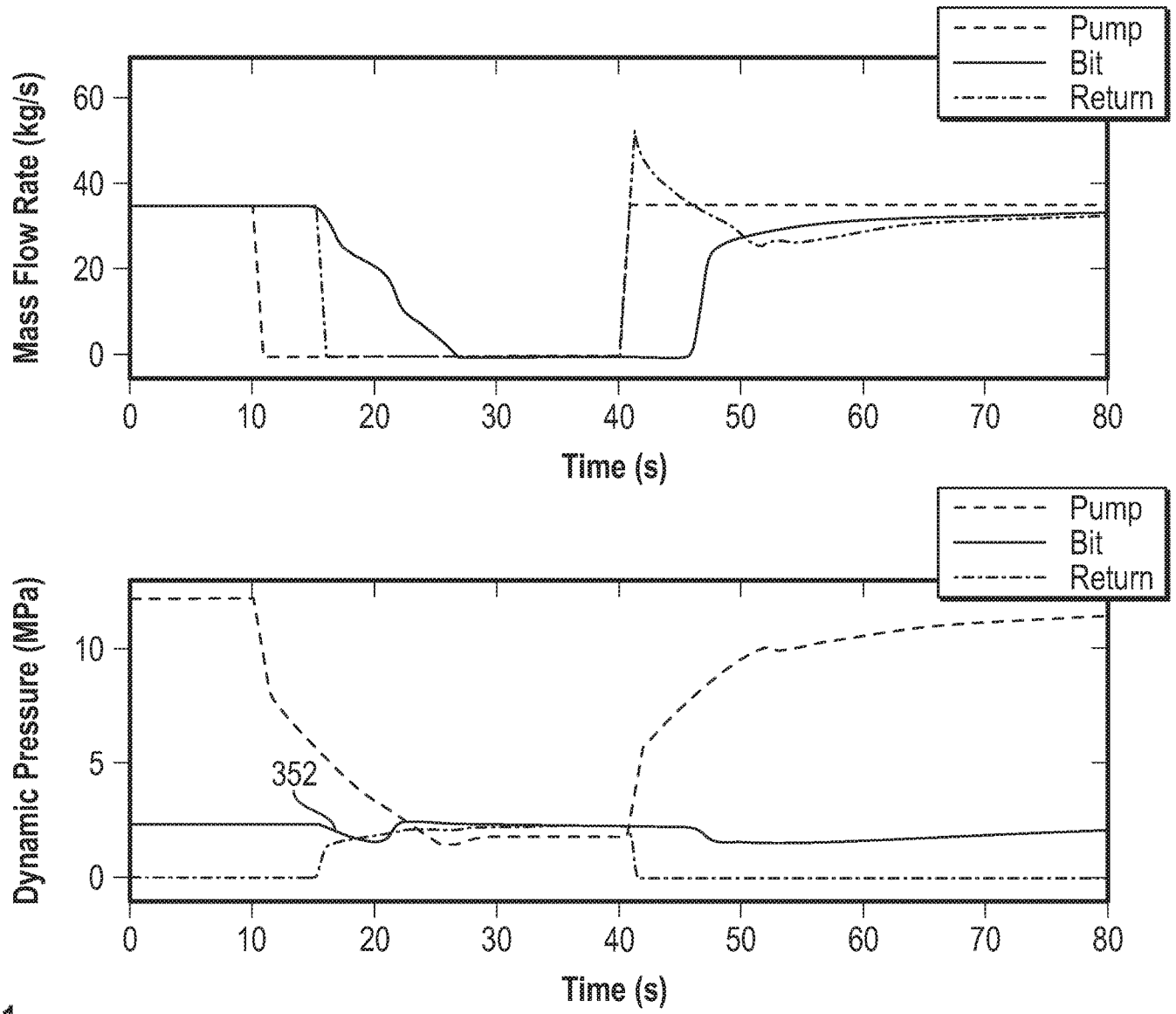
FIG. 11 is a data graph illustrating a simulation of a pump stop and a pump resume cycle with a delayed stop of the return flow in accordance with principles disclosed herein.

The quasi-static analysis described above is not necessarily intended to predict how the downhole pressure varies in the transient period between starting of the flow stop to establishing the static equilibrium pressure. The pressure simulation model described in Equations 5 to 14 may be used to estimate transient pressure variations. Example simulations may accomplished with the following key parameters assigned the selected values that are listed here. Results are shown in FIGS. 9, 10, and 11.

L=5000 m drill string length (4800 m×5" DP+200 m×5.5" HWDP)

n=20 number of string elements $V_i$=45.2 $m^3$ inner pipe volume $V_a$=133.3 $m^3$ annulus volume (diameters: 9" to 2500 m, 8.75" beyond)

$\rho$=1390 $kg/m^3$ nominal fluid density $\kappa = 8.5 \cdot 10^{-10}$ $Pa^{-1}$ nominal fluid compressibility Q=0.025 $m^3/s$ nominal volumetric pump rate (=1500 lpm)

The predicted pressure loss is based on a fluid rheology characterized by viscometer readings of [4 5 14 23 30 51]° of the standard Fann viscometer running at standard speeds ([3 6 100 200 300 600] rpm). The pressure simulation model uses pressure and temperature dependent densities, compressibility and viscosity but the variations around the nominal values given above are relatively small. Notice that the wave propagation speed based on the data above is $c = (\rho\kappa)^{-1/2} = 920$ m/s, thus representing an expected acoustic delay time of $\Delta t = L/c \approx 5.4$ s. This is the time from a variation of a surface actuator can be detected at the lower end of the string.

Reference is made to the FIGS. 9-11, illustrating simulation results for flow rates and dynamic pressures for three different scenarios. The mass flow rates, given as mass flow rates at three different positions in the flow loop: at pump, though the bit (nozzles) and out of the well (return flow). The dynamic pressure, which is the total pressure minus the hydrostatic pressure with open return end, is similarly logged at the same positions. The bit pressure now represents the well bore pressure outside the bit. Bit pressure is a key control variable during drilling well with small pressure margins. The goal is to keep the bit pressure between the pore pressure and fracture pressure limits of the formation.

FIG. 9 shows a simulated reference case when there is no restriction of the return flow. At time t=10 s the pump stops during a ramp down time of 1 s (i.e. 1 second). The simulation indicates that the flow rates through the nozzles and out of the well begin to drop after delays of, respectively, 5.5 s and 11 s, approximately. At 40 s, while the flow is nearly zero, the pump quickly resumes its previous speed. Again the nozzle and return flow are delayed. For this example, the flow rates have tails substantially longer than in the stopping case. The reason may be the effect of the non-Newtonian rheology and the corresponding non-linear friction losses in the pipe and through the nozzles. The simulated pressure responses of the temporary flow stop show that the dynamic downhole pressure vanishes gradually as the flow stops. In difficult cases, the loss of the entire dynamic pressure loss component can cause the downhole pressure to fall below the pore pressure. This can result in an influx of gas.

Referring to FIG. 10, the next simulated scenario is when the return flow at surface is stopped synchronously with the pump. In this case we see that the downhole pressure is not dropping to zero but increases beyond the normal dynamic friction losses, starting at a time indicated by reference number 342. The trapped pressure in annulus, during the steady state interval from 25 s to 40 s, is slightly higher than the trapped pressure inside the string. This is a consequence of a check valve being included in the pressure simulation model. This kind of valve is standard equipment in the drill string as it purposely hinders reverse flow through the bit and drill string. The peak return flow rate at about 42 s comes from the trapped annular pressure being suddenly released when the pump starts and the return flow suddenly becomes unrestricted. This situation with a static excessive downhole pressure is also undesirable, especially if the pressure exceed the fracture pressure.

Referring to FIG. 11, the third and last simulated scenario includes a 5 s closing delay of the annular valve on the return flow at the surface (e.g. valve 22 in FIG. 1. This delay cause enough fluid to escape from the flow loop so that the trapped pressure stabilizes at a value close to the normal circulating pressure. The delay causes a temporary and moderate drop in the downhole pressure (indicated by reference number 352) before the pressures in annulus and inside the pipe equalize. When the flow is resumed again at about 40 s the return flow is opened synchronously (without delay) with the rapid resuming of the pumping rate. The downhole pressure also now has a temporary but relatively small drop before normal steady state flow conditions slowly are picked up again.

Additional simulations with delayed return valve opening show that such a delay would give a temporary but high peak in the downhole pressure. Additional simulations suggest that the ramp-down and ramp up-times of the pump may have little effect when they are substantial shorter than the acoustic travelling time from top to bottom. When they are longer, they make the downhole pressure transient drops more pronounced. It is therefore a characteristic feature of various embodiments of the current method that the input flow rate and return flow restriction is varied rapidly and characterized by short ramp times.

The described method with short ramps may be operated as a version of Managed Pressure Drilling without traditional pressure control devices like a choke and the rotating control device (RCD). A basic version of the method can be regarded as a feed forward control system because there is no pressure feedback in the control methodology. The only variable is the closing delay time which is calculated prior to the circulation stop. To account for potential errors in the pressure simulation model being the basis for calculating the delay time, it may be desirable to have a simple control device to adjust the closed well head pressure. This device can be used both for increasing the well head pressure if too low, and for reduce it if too high. Such a device could be realized by several means, such as a using a so-called progressive cavity pump or a centrifugal pump. The former can handle bi-directional flow and work both as a pump if fluid is pumped into the well and as a hydraulic motor powering an electric machine now acting as a generator. A centrifugal pump can also work as a constant pressure device allowing flow to be bidirectional. The latter case is discussed in more detail below.

Figure 12:
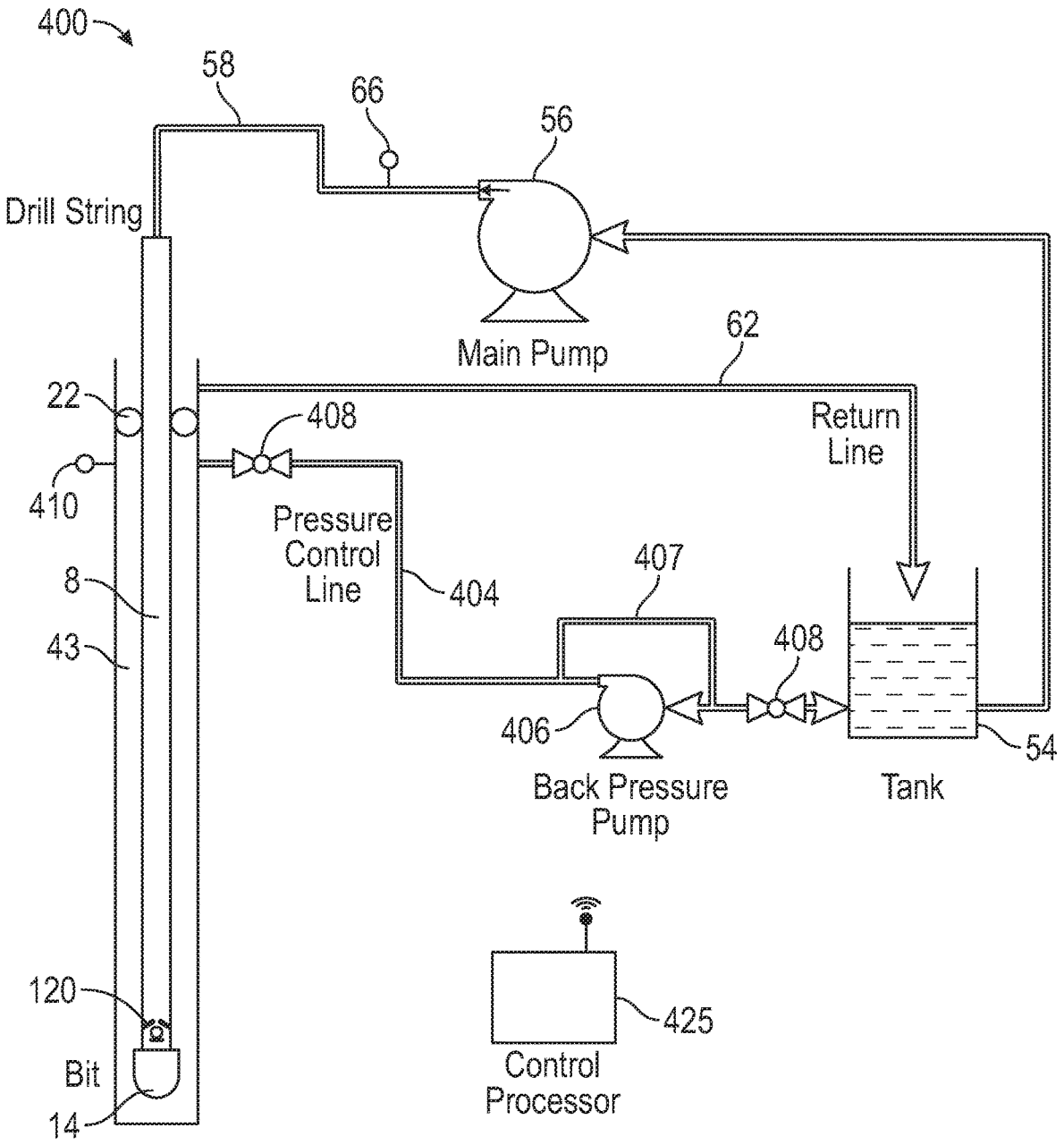
FIG. 12 is a schematic elevation view of an embodiment of a drilling system for controlling the fluid pressure in a borehole in accordance with principles disclosed herein.

Referring now to FIG. 12, an embodiment of a drilling system 400 in accordance with the principles described herein is shown. System 400 a drill string 8, a supply pump 56, a flow sensor 66 in a supply line 58 connected to the outlet of pump 56, an annulus pressure control valve 22, a drilling fluid return line 62, a back pressure control line 404, and a fluid pressure control system 425. Drill string 8, pump 56, valve 22, and return line 62 are each as previously described. In particular, drill string 8 includes a drill bit 14 and a check valve 120 preventing reverse flow from annulus 43 back into the drill string 8. In addition, pump 56 is coupled to the top of the string drill string 8 for pumping drilling fluid down drill string 8. Return line 62 provides fluid communication between control valve 22 and a drilling fluid reservoir such as mud tank 54. Similar to return line 62, back pressure control line 404 extends from annulus 43 and tank 54, however, in this embodiment, line 404 is coupled to annulus 43 below valve 22, whereas return line 62 is coupled to annulus 43 above valve 22. As will be described in more detail below, line 404 allows bi-directional flow in or out of the annulus 43. A back pressure control pump 406 is provided along line 404 to control pressure in annulus 43. Valves 408 provided along line 404 control the flow through line 404. A pressure gauge or pressure sensor 410 is positioned to measure the pressure in annulus 43 immediately below valve 22.

Pressure control pump 406 delivers the pressure (head) to compensate for the maximum dynamic annular pressure loss, for example 3 MPa. In this embodiment, a bypass line 407 is provided along line 404 to bypass pump 406 as desired. However, in embodiments where there is no bypass line 407 in parallel with this pump, the normal mode of operation is to use pump 406 to maintain a constant pressure at a virtually zero flow rate, during typical drilling operations. In transient phases, pump 406 is operated to accommodate a relatively small residual flow in both directions, including replenishment flow 330 of FIG. 7, for example. Pump 406 may be a typical centrifugal pump having a relatively flat pressure head characteristics around zero flow rate, so a constant pressure may be achieved through a constant or nearly constant rotation speed of the pump. The zero flow pressure head is proportional to the rotation speed squared so the speed of the centrifugal pump may be selected to match or achieve a desired well head pressure, as may be measured and confirmed by sensor 410. Although calculations or a chart for a centrifugal pump can estimate flow rate based pressure measurements, some embodiments include a flow sensor in pressure control line 404 to measure the flow rate therein. If cutting particles in the return fluid are so damaging to the pump impeller that reverse flow is highly undesirable, bypass line 407 may be employed. This bypass line can be used to offset the working point of the pump 406 so that the pump flow in normal direction matches the leak flow through the bypass line 407 when there is zero net return flow from the well. Reverse flow through the pump 406 will take place when the net return flow exceeds the leak flow through the bypass line 408.

Embodiments described herein may be implemented in connection with other well control procedures. In such scenarios, if a well stability issue arises, the disclosed wellhead pressure control means (e.g. the pressure control pump 406 and the bypass line 404) can be disabled through a valve 408 so that the other well control procedures can be used. Re-routing of mud from the mud pumps to the kill line can be an alternative. Use of the choke line can be a means for reducing excessive pressure.

Figure 13:
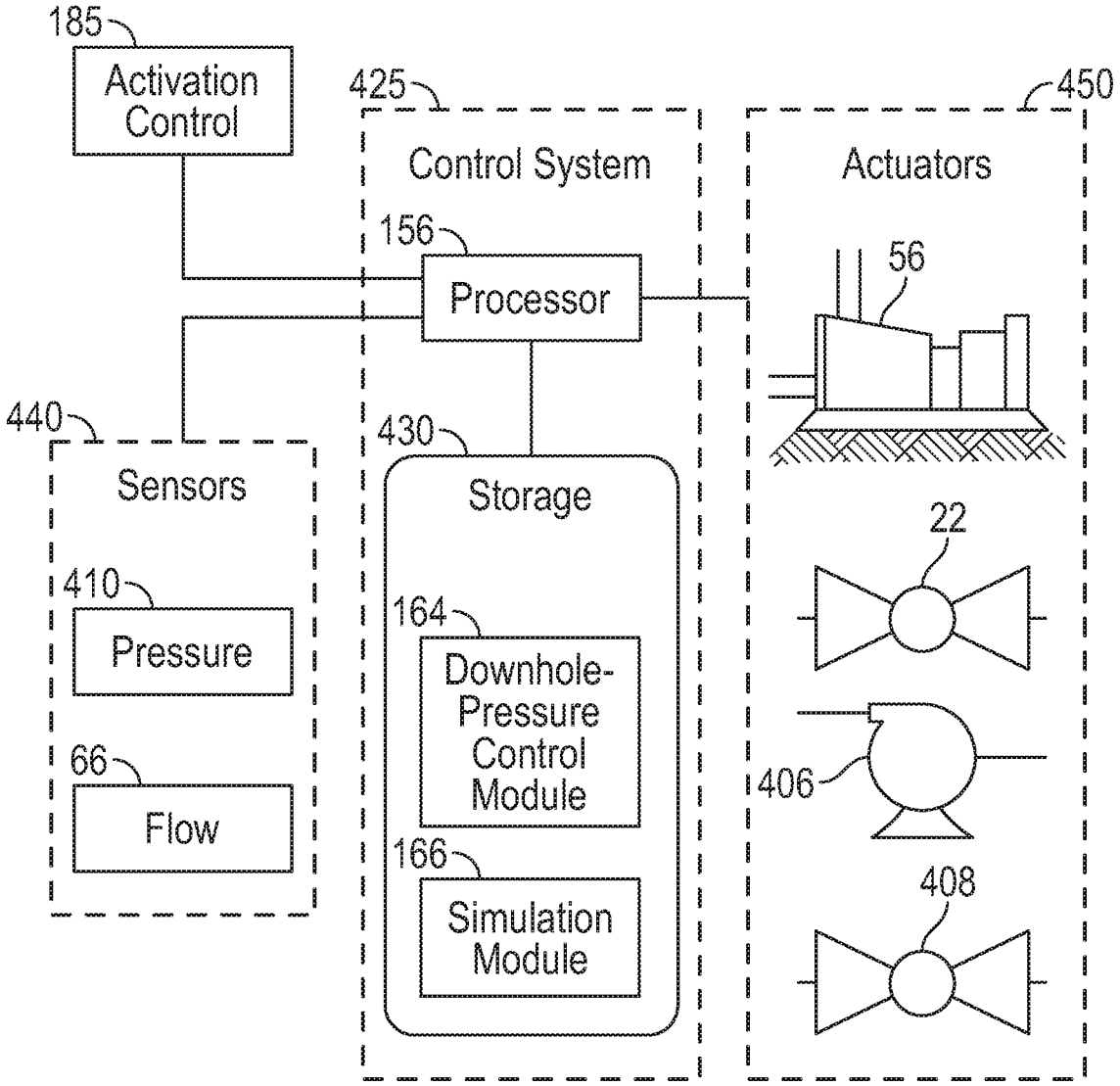
FIG. 13 is a schematic block diagram of an embodiment of a processing system for controlling the fluid pressure in a borehole using the system of FIG. 12 in accordance with principles disclosed herein.

Referring now to FIG. 13, a block diagram illustrating the fluid pressure control system 425 and connections thereto is shown is shown. System 425 is coupled to one or more sensors 440, one or more actuators 450, and an activation control switch 185 as previously described. System 425 includes a processor 156 and storage 430. Processor 156 may be any suitable processor, as described elsewhere herein. The operation of valve 22 is controlled with fluid pressure control system 425 to manage the pressure of drilling fluid in the annulus 43.

As understood by those skilled in the art, processors execute software instructions. Software instructions alone are incapable of performing a function. Therefore, in the present disclosure, any reference to a function performed by software instructions, or to software instructions performing a function is simply a shorthand means for stating that the function is performed by a processor executing the instructions.

The storage 430 is a non-transitory computer-readable storage medium suitable for storing instructions executable by the processor 156, and for storing measurements received from the sensors 440, calculate results. The capabilities and configuration of storage 430 are similar to those of storage 160 previously described. For example, storage 430 includes a downhole-pressure control module 164 as previously described. Module 164 includes instructions that when executed cause the processor 156 to perform the operations disclosed herein, including, for example, the operations of embodiments of method 300. Storage 430 further includes a simulation module 166. Module 166 includes instructions that when executed cause the processor 156 to perform the functions of the pressure simulation model as previously described to provide estimates of pressure losses and compression volumes as a function of steady state flow rates for the drilling fluid in system 400. For example, module 166 may include instructions to evaluate Equations 5 to 14.

The sensors 440 coupled to the control system 425 include pressure sensor 410 and flow sensor 66 previously described. Actuators 450 include control valve 22, pump 56, pump 406, and control valves 408. Activation control switch 185 functions as described above to activate the control system 425. Though described as a generally passive member, check valve 120 at the bottom of drill string 8 participates in the functionality implemented by control system 425.

In other embodiments, sensors 440 may include another pressure sensor positioned at another location, such as a pressure sensor 15, 65, 112, positioned as described with respect to FIGS. 1 and 4, as examples. In addition, in some embodiments, actuators 450 include a control valve 110 as previously described and shown in FIG. 1. Such a control valve 110 may assist or replace the annular seal member 22 for controlling or retaining pressure downhole when pump 56 is deactivated or drilling fluid is not flowing in borehole 16. For example, in such embodiments, processor 156 directs control valve 110 to perform the functions and to achieve the open and closed states attributed to seal member/valve 22 as shown in FIG. 2 and FIG. 3.

Well system 400, including control system 425, may be operated according to embodiments of method 300 and may be operated to perform methods of the pressure simulation model described above.

Some embodiments of well system 1, including control system 150, are configured to perform methods of the pressure simulation model described above. While exemplary embodiments have been shown and described, modifications thereof can be made by one of ordinary skill in the art without departing from the scope or teachings herein. The embodiments described herein are exemplary only and are not limiting. Many variations, combinations, and modifications of these embodiments or their various features are possible and are within the scope of the disclosure. Accordingly, the scope of protection is not limited to the embodiments described herein, but is only limited by the claims that follow, the scope of which shall include all equivalents of the subject matter of the claims. The inclusion of any particular method step or operation within the written description or a figure does not necessarily mean that the particular step or operation is necessary to the method. If feasible, the steps or operations of a method may be performed in any order, except for those particular steps or operations, if any, for which a sequence is expressly stated. In some implementations two or more of the method steps or operations may be performed in parallel, rather than serially. The recitation of identifiers such as (a), (b), (c) or (1), (2), (3) before operations in a method claim are not intended to and do not specify a particular order to the operations, but rather are used to simplify subsequent reference to such operations.

What is claimed is:

1. A method for drilling a borehole in an earthen formation, the method comprising:

(a) selecting a lower pressure limit for a drilling fluid at a drilling location in the borehole;

(b) selecting an upper pressure limit for the drilling fluid at the drilling location in the borehole;

(c) activating a pump to circulate the drilling fluid:

(i) down a drill string extending through a BOP and a control valve to a drill bit at a lower end of the drill string, (ii) out the drill bit into the borehole, (iii) up an annulus disposed about the drill string, and (iv) out of the annulus through a return line, wherein a check valve is disposed in the drill string proximal the lower end and the control valve is positioned along the annulus below the return line, wherein the check valve is configured to allow one-way flow of the drilling fluid down the drill string and out the bit, and wherein the drilling fluid passes through the drilling location while circulating;

(d) rotating the drill bit to drill the borehole;

(e) operating the pump to maintain the drilling fluid at the drilling location at a pressure that is between the upper pressure limit and the lower pressure limit;

(f) deactivating the pump to stop circulating the drilling fluid in (c);

(g) preventing the drilling fluid from flowing up the drill string with the check valve after (f); and (h) closing the control valve at a selected time after deactivating the pump in (f) to seal the drilling fluid in the annulus between the check valve and the control valve below the return line and maintain the pressure of the drilling fluid at the drilling location greater than the lower pressure limit and less than the upper pressure limit after (g).

2. The method of claim 1, further comprising:

(i) activating the pump and opening the control valve after (h) to circulate the drilling fluid down the drill string to the drill bit, out the drill bit, and up the annulus.

3. The method of claim 2, wherein (i) further comprises opening the control valve at a selected time after activating the pump to maintain the pressure of the drilling fluid at the drilling location greater than the lower pressure limit and less than the upper pressure limit.

4. The method of claim 2, further comprising adding a pipe joint to the pipe string after (f) and before (i).

5. The method of claim 1, wherein (c) further comprises attaining and maintaining the mud pressure at a level greater than the lower pressure limit and less than the upper pressure limit.

6. The method of claim 5, wherein the lower pressure limit is equal to a pore pressure at the drilling location, and the upper pressure limit is equal to a fracturing pressure at the drilling location.

7. The method of claim 1, wherein the drilling location is the location of the drill bit coupled to the bottom of the pipe string, the location of the drill bit changing as the drill bit drills the borehole.

8. The method of claim 1, further comprising providing a replenishment flow of the drilling fluid from a drilling fluid reservoir into the annulus while the control valve is closed as a result of (h).

9. The method of claim 8, wherein the replenishment flow is provided by a second pump, the second pump being a centrifugal pump.

10. A system for controlling borehole pressure during drilling operations, the system comprising:

a drill string extending through a borehole, wherein the drill string has an upper end, a lower end, a drill bit disposed at the lower end, and a check valve at the lower end, wherein the check valve is configured to allow one-way flow of a drilling fluid down the drill string and out the drill bit;

an annulus disposed between the drill string and a sidewall of the borehole;

a BOP positioned at an upper end of the borehole;

a control valve coupled to the BOP and configured to selectively open and close the annulus, wherein the drill extends through the BOP and the control valve;

a drilling fluid circulation system including:

a first pump coupled to the upper end of the drill string and configured to pump the drilling fluid down the drill string; and a return line in fluid communication with the annulus above the control valve; and a fluid pressure control system configured to operate the control valve and the first pump, wherein the fluid pressure control system includes a processor and a non-transitory computer-readable storage medium;

wherein the storage medium stores instructions that when executed by the processor cause the processor to:

(i) select a lower pressure limit for the drilling fluid at a drilling location in the borehole;

(ii) select an upper pressure limit for the drilling fluid at the drilling location in the borehole;

(iii) activate the first pump to circulate the drilling fluid down the drill string and out the drill bit into the borehole;

(iv) operate the first pump to maintain the drilling fluid at the drilling location at a pressure that is between the upper pressure limit and the lower pressure limit;

(vi) deactivate the first pump to stop circulating the drilling fluid down the drill string and out the drill bit; and (vii) close the control valve at a selected time after deactivating the first pump in (vi) to seal the drilling fluid in the annulus between the check valve and the control valve below the return line and maintain the pressure of the drilling fluid at the drilling location greater than the lower pressure limit and less than the upper pressure limit.

11. The system of claim 10, further comprising:

a backpressure control line in fluid communication with the annulus below the control valve; and a second pump disposed along the backpressure control line and configured to pump the drilling fluid into the annulus below the control valve.

12. The system of clam 11, wherein the second pump is a bi-directional pump.

13. The system of claim 11, wherein the fluid pressure control system is configured to operate the second pump to maintain the pressure of the drilling fluid at the drilling location at a constant value after (vi).

14. A method for drilling a borehole in an earthen formation, the method comprising:

(a) drilling a borehole in an earthen formation with a drill bit disposed at a lower end of a drill string that extends through a BOP, a control valve, and the borehole;

(b) pumping a drilling fluid down a drill string, up an annulus between the drill string and a sidewall of the borehole, and out of the annulus through a return line;

(c) ceasing the pumping of the drilling fluid down the drill string and up the annulus;

(d) preventing the drilling fluid from flowing up the drill string after (c);

(e) sealing the annulus proximal an upper end of the borehole and below the return line with the control valve after a first predetermined period of time after (c); and (f) using a pressure simulation model to determine the first predetermined period of time.

15. The method of claim 14, further comprising:

(g) pumping the drilling fluid down the drill string and up an annulus between the drill string and a sidewall of the borehole after (c), (d), (e), and (f);

(h) opening the annulus proximal the upper end of the borehole after a second predetermined period of time after (g); and using the pressure simulation model to determine the second predetermined period of time.

16. The method of claim 15, further comprising adding a pipe joint to the pipe string after (c) and before (g).

17. The method of claim 14, further comprising:

selecting a lower pressure limit for the drilling fluid at a drilling location in the borehole;

selecting an upper pressure limit for the drilling fluid at the drilling location in the borehole; and maintaining the drilling fluid at the drilling location at a pressure that is between the upper pressure limit and the lower pressure limit during (a), (b), and after (e).

18. The method of claim 17, wherein the drilling location is the location of the drill bit.

19. The method of claim 14, further comprising providing a replenishment flow of the drilling fluid from a drilling fluid reservoir into the annulus while the annulus is sealed after (f).

20. The method of claim 19, wherein the replenishment flow is pumped into the annulus below a location where the annulus is sealed in (e).

* * * * *